US011110720B2

(12) United States Patent
Tanizaki et al.

(10) Patent No.: US 11,110,720 B2
(45) Date of Patent: Sep. 7, 2021

(54) THERMAL-TRANSFER PRINTER

(71) Applicant: Brother Kogyo Kabushiki Kaisha, Nagoya (JP)

(72) Inventors: Masashi Tanizaki, Kuwana (JP); Yasuyuki Narumiya, Nagakute (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 358 days.

(21) Appl. No.: 16/163,689

(22) Filed: Oct. 18, 2018

(65) Prior Publication Data

US 2019/0118553 A1 Apr. 25, 2019

(30) Foreign Application Priority Data

Oct. 20, 2017 (JP) ..... JP2017-203895

(51) Int. Cl.

| | |
|---|---|
| ***B41J 2/325*** | (2006.01) |
| ***B41J 33/00*** | (2006.01) |
| ***B41J 17/32*** | (2006.01) |
| ***B41J 15/04*** | (2006.01) |

(52) U.S. Cl.

CPC ..... *B41J 2/325* (2013.01); *B41J 15/042* (2013.01); *B41J 17/32* (2013.01); *B41J 33/003* (2013.01)

(58) Field of Classification Search

CPC . B41J 2/325; B41J 15/042; B41J 17/32; B41J 33/003

See application file for complete search history.

(56) References Cited

U.S. PATENT DOCUMENTS

| | | | | |
|---|---|---|---|---|
| 8,882,371 | B2 * | 11/2014 | Chen | B41J 2/14 400/224.2 |
| 10,773,527 | B2 * | 9/2020 | Watanabe | B65H 19/30 |
| 2002/0041782 | A1 * | 4/2002 | Mastinick | B41J 29/38 400/192 |
| 2002/0172537 | A1 * | 11/2002 | Hamisch, Jr. | B41J 32/00 400/191 |
| 2005/0271449 | A1 * | 12/2005 | Hirte | B41J 15/042 400/642 |
| 2015/0015397 | A1 * | 1/2015 | Lawver | G07F 19/205 340/561 |
| 2015/0042742 | A1 * | 2/2015 | Onodera | B41J 29/13 347/220 |
| 2015/0092202 | A1 * | 4/2015 | Kawai | G06K 15/1868 358/1.2 |

(Continued)

FOREIGN PATENT DOCUMENTS

JP 2017-503684 A 2/2017

*Primary Examiner* — David H Banh

(74) *Attorney, Agent, or Firm* — Banner & Witcoff, Ltd.

(57) ABSTRACT

A thermal-transfer printer, including a first case, a second case, an ink ribbon supporting member, a cover, and a head holder, is provided. The first case has a first opening on an upper side thereof. The second case is located on the upper side of the first case and attached movably to the first case to open and close the first opening. The second case includes a second opening on an upper side thereof and a third opening on a lower side thereof. The ink ribbon supporting member is attached to one of the first case and the second case. The cover is attached movably to the second case to open and close the second opening. The head holder is attached to the inner face of the cover and holds a printing head.

20 Claims, 28 Drawing Sheets

(56) References Cited

U.S. PATENT DOCUMENTS

| | | | | |
|---|---|---|---|---|
| 2015/0116442 | A1* | 4/2015 | Tanaka | B41J 3/4075 347/218 |
| 2015/0165797 | A1 | 6/2015 | Chari et al. | |
| 2015/0165802 | A1 | 6/2015 | Wong et al. | |
| 2015/0225105 | A1* | 8/2015 | Sakaino | B41J 3/4075 118/712 |

* cited by examiner

THERMAL-TRANSFER PRINTER

CROSS REFERENCE TO RELATED APPLICATION

This application claims priority from Japanese Patent Application No. 2017-203895, filed on Oct. 20, 2017, the entire subject matter of which is incorporated herein by reference.

BACKGROUND

Technical Field

An aspect of the present disclosure is related to a thermal-transfer printer.

Related Art

A smaller-sized media processing device, in which replaceable consumable supplies, such as an ink ribbon and a printing medium, are easily accessible to a user, is known. The media processing device may include a base and a lid hingedly attached to the base. When the lid is at an open position, the user may access a cavity that accommodates a cartridge case containing the ink ribbon and the printing medium. In other words, the media processing device may allow the user to access multiple consumable supplies, which include at least the ink ribbon and the printing medium, by placing the lid at the open position.

SUMMARY

While the media processing device may provide access to the multiple consumable supplies at a time by placing the lid at the open position, it may not be easy for the user to recognize which one of the multiple consumable supplies the user is currently in need for replacement.

The present disclosure is advantageous in that a thermal-transfer printer, in which consumable supplies to be replaced are more clearly recognizable and accessible, is provided.

According to an aspect of the present disclosure, a thermal-transfer printer, including a first case, a second case, an ink ribbon supporting member, a cover, and a head holder, is provided. The first case has a first opening on an upper side thereof and is configured to store at least a part of a printing medium. The second case is located on the upper side of the first case and is attached movably to the first case to open and close the first opening. The second case has a second opening on an upper side thereof under a condition where the second case closes the first opening and a third opening on a lower side thereof under the condition where the second case closes the first opening. The ink ribbon supporting member, to which an ink ribbon is attachable, is attached to one of the first case and the second case. The cover is attached movably to the second case and is configured to open and close the second opening. The cover has an inner face facing toward the second case an outer face facing opposite to the second case under a condition where the cover closes the second opening. The head holder is attached to the inner face of the cover and is configured to hold a printing head.

BRIEF DESCRIPTION OF THE ACCOMPANYING DRAWINGS

Figure 5:
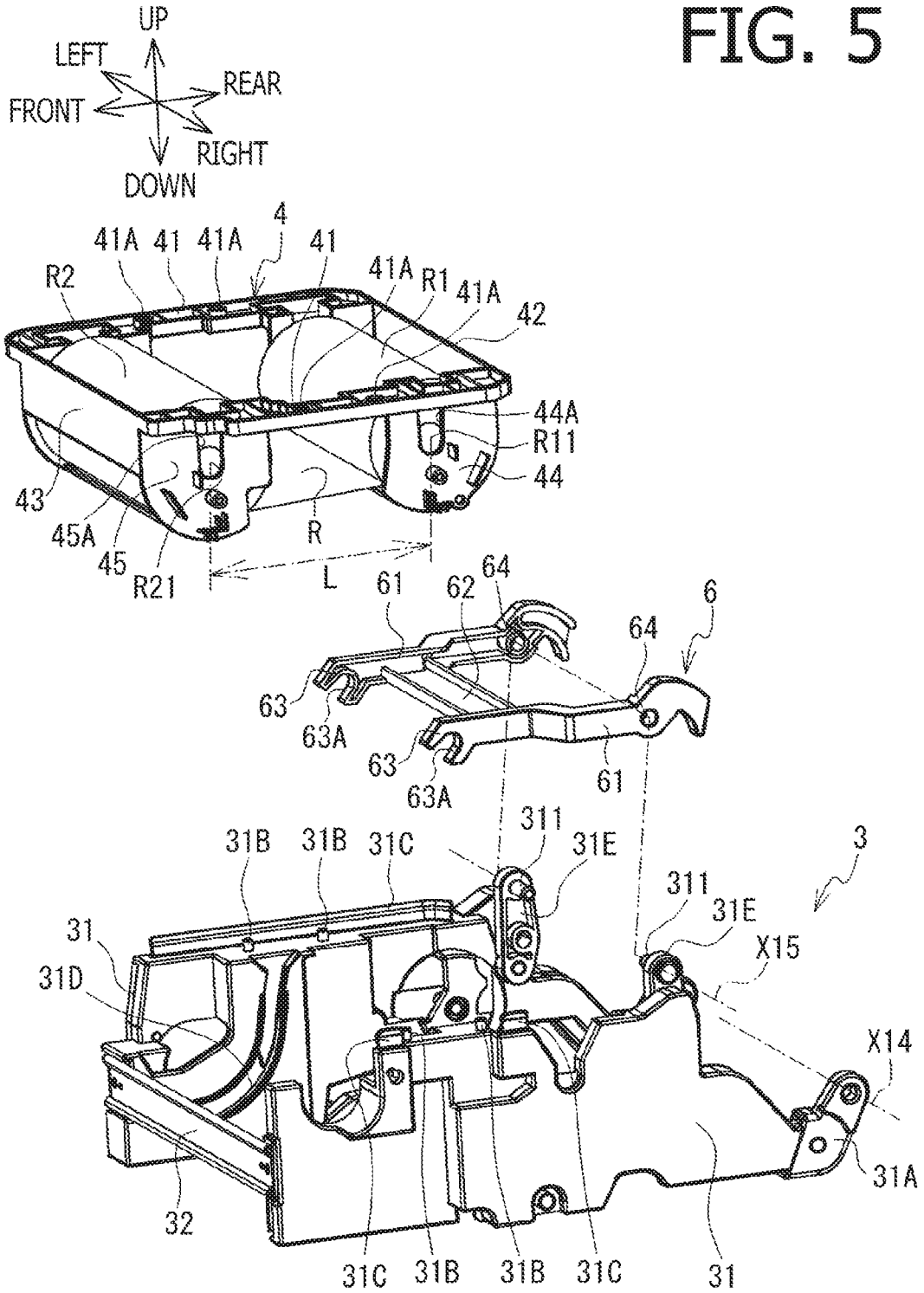

FIG. 5 is an exploded perspective view of an ink ribbon supporting member 3, a cartridge case 4, and a subsidiary arm 6 in the thermal-transfer printer 1A according to the embodiment of the present disclosure.

Figure 6:
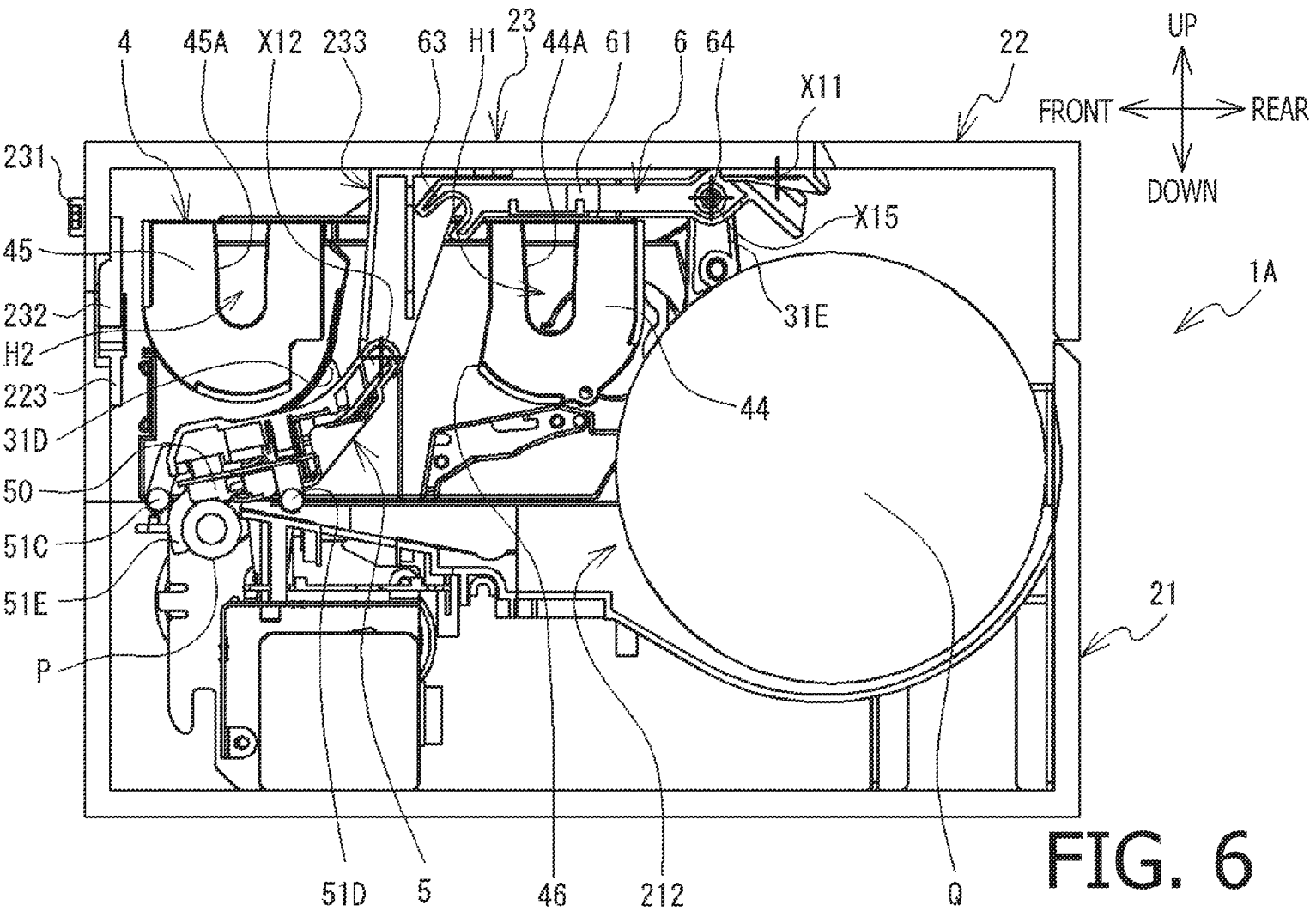

FIG. 6 is a cross-sectional view of the thermal-transfer printer 1A according to the first embodiment of the present disclosure with the cover 23 at the first position (closed position).

Figure 7:
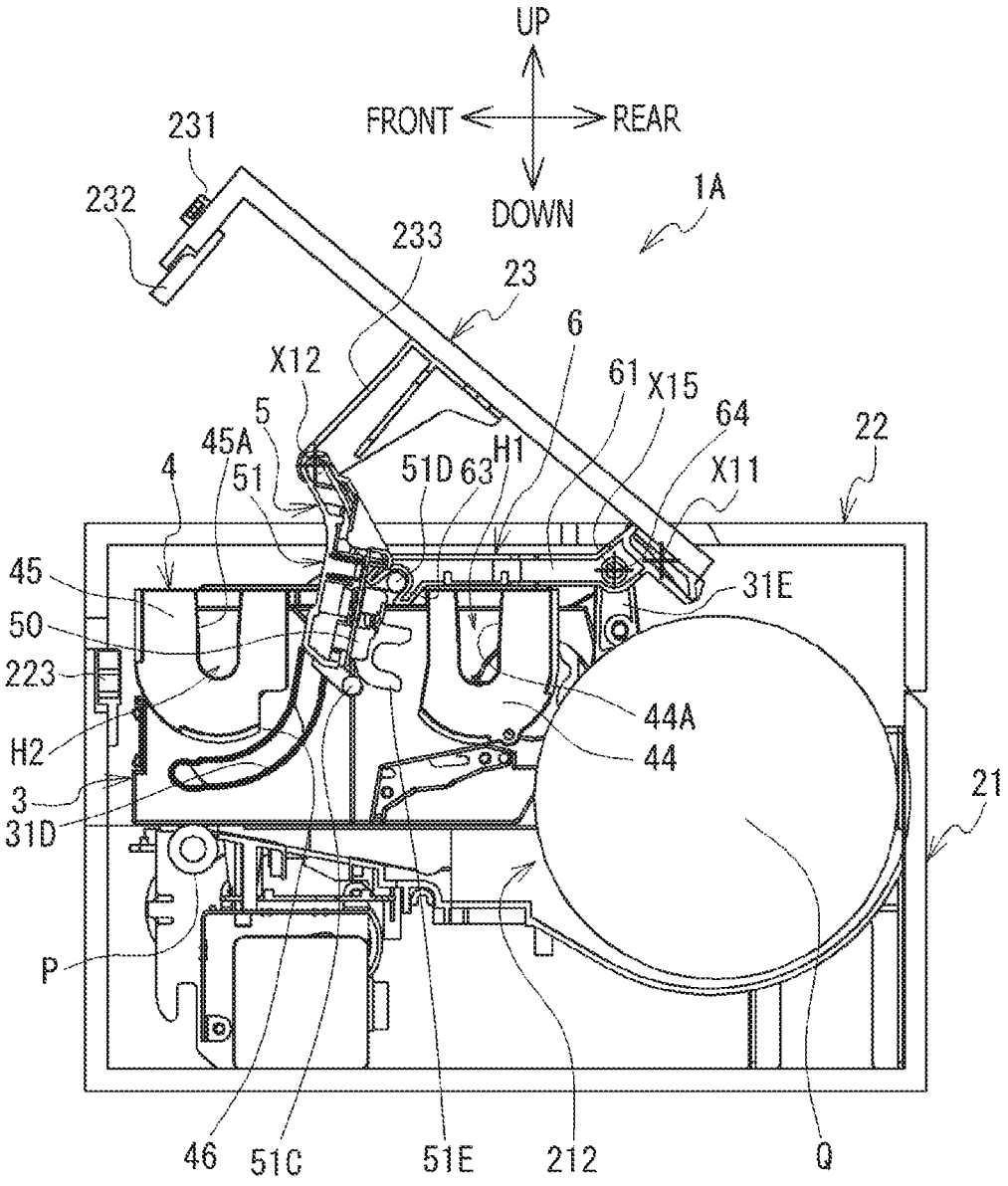

FIG. 7 is a cross-sectional view of the thermal-transfer printer 1A according to the first embodiment of the present disclosure with the cover 23 at an interim position between the first position (closed position) and the second position (open position).

Figure 8:
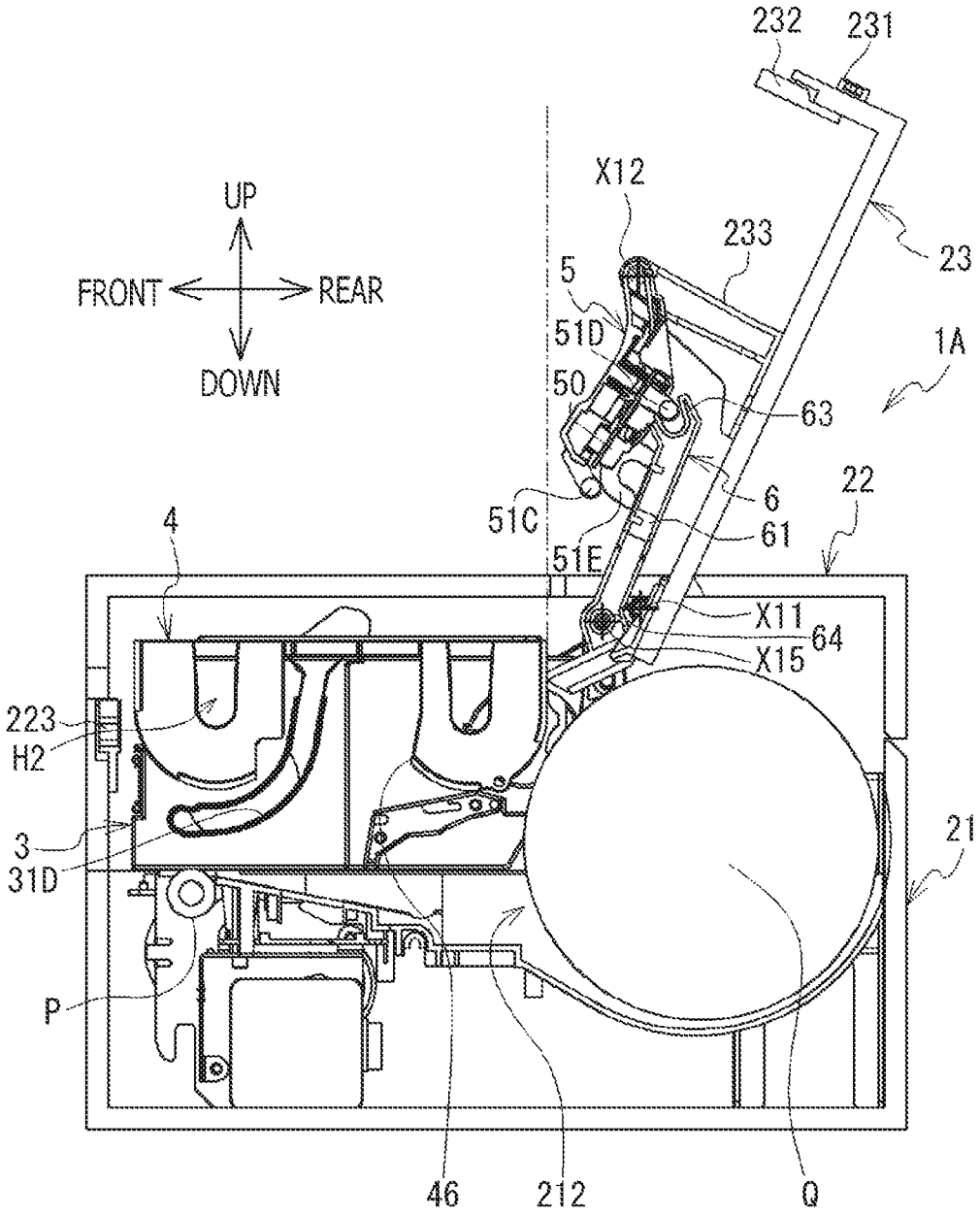

FIG. 8 is a cross-sectional view of the thermal-transfer printer 1A according to the first embodiment of the present disclosure with the cover 23 at the second position (open position).

Figure 9:
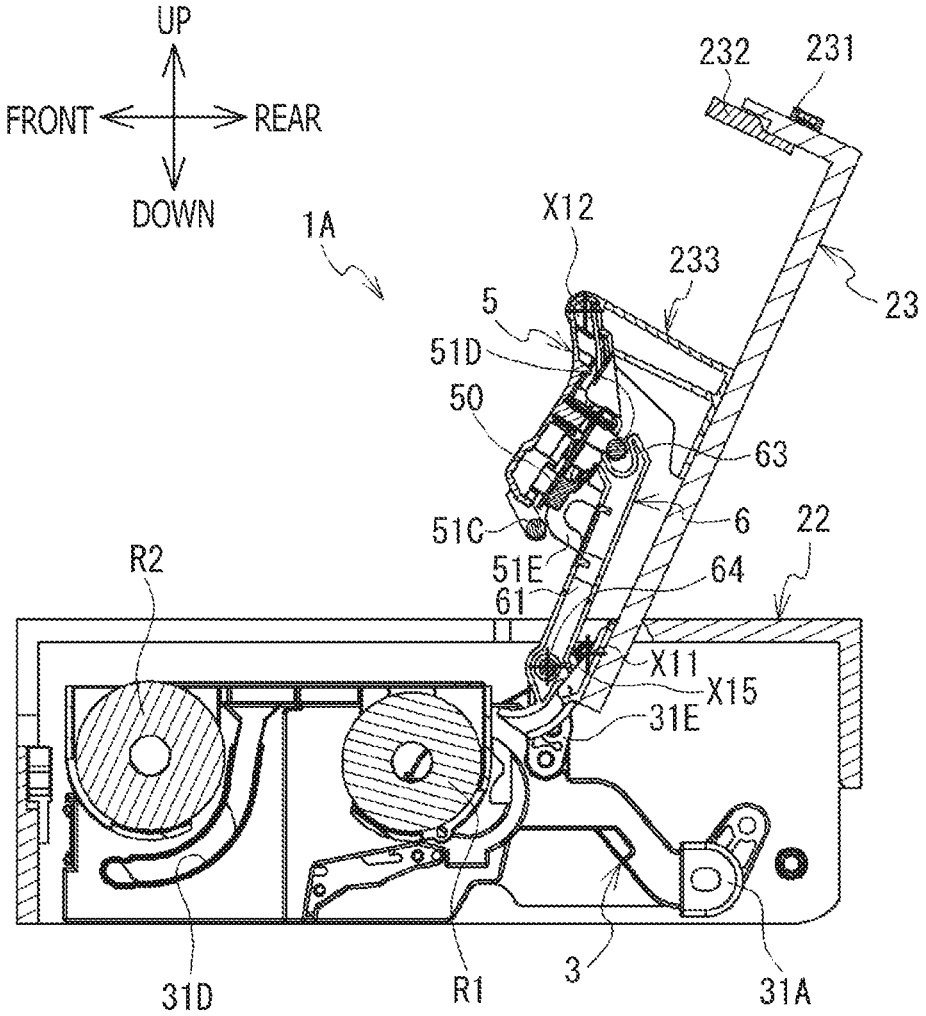

FIG. 9 is a cross-sectional partial view the thermal-transfer printer 1A according to the first embodiment of the present disclosure with the cover 23 at the second position (open position).

Figure 10:
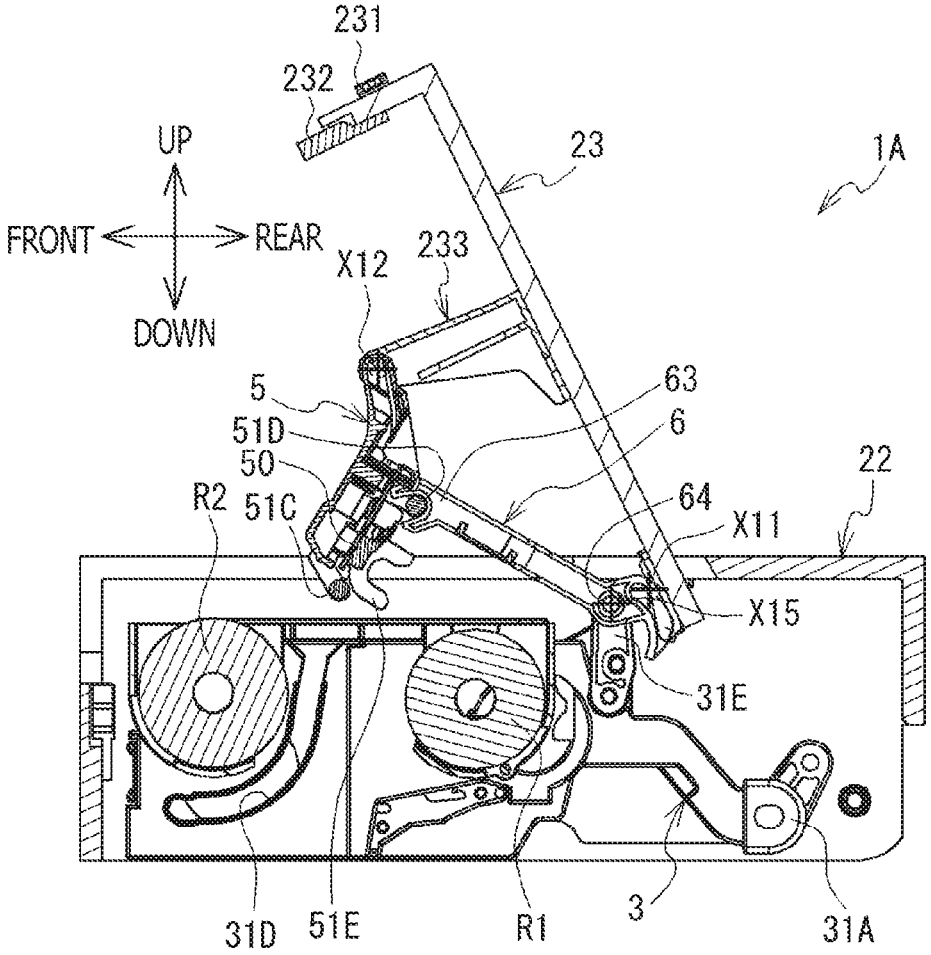

FIG. 10 is a cross-sectional partial view of the thermal-transfer printer 1A according to the first embodiment of the present disclosure with the cover 23 at an interim position between the second position (open position) and the first position (closed position).

Figure 11:
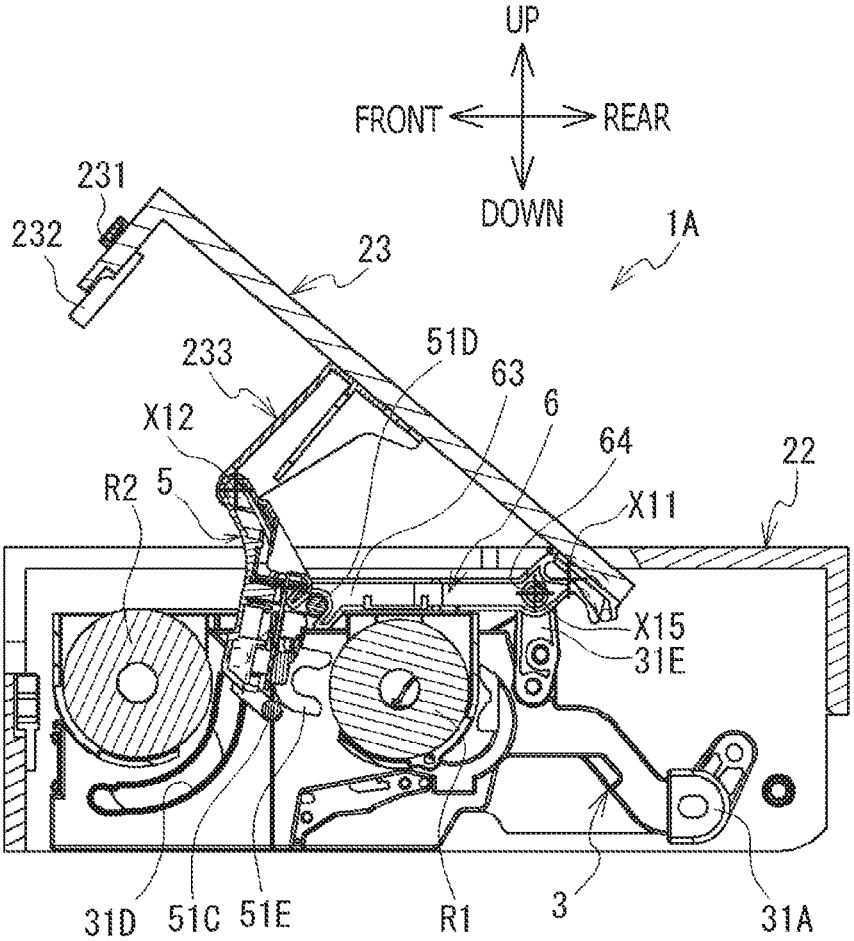

FIG. 11 is a cross-sectional partial view of the thermal-transfer printer 1A according to the first embodiment of the present disclosure with the cover 23 moved further toward the first position (closed position).

Figure 12:
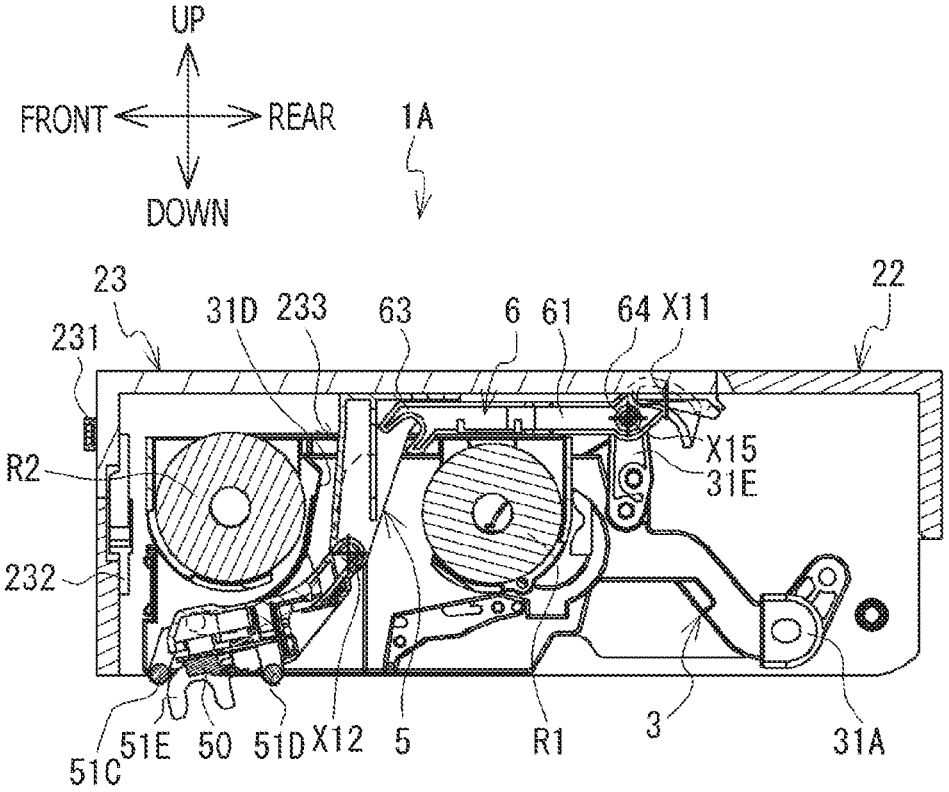

FIG. 12 is a cross-sectional partial view the thermal-transfer printer 1A according to the first embodiment of the present disclosure with the cover 23 at the first position (closed position).

Figure 13:
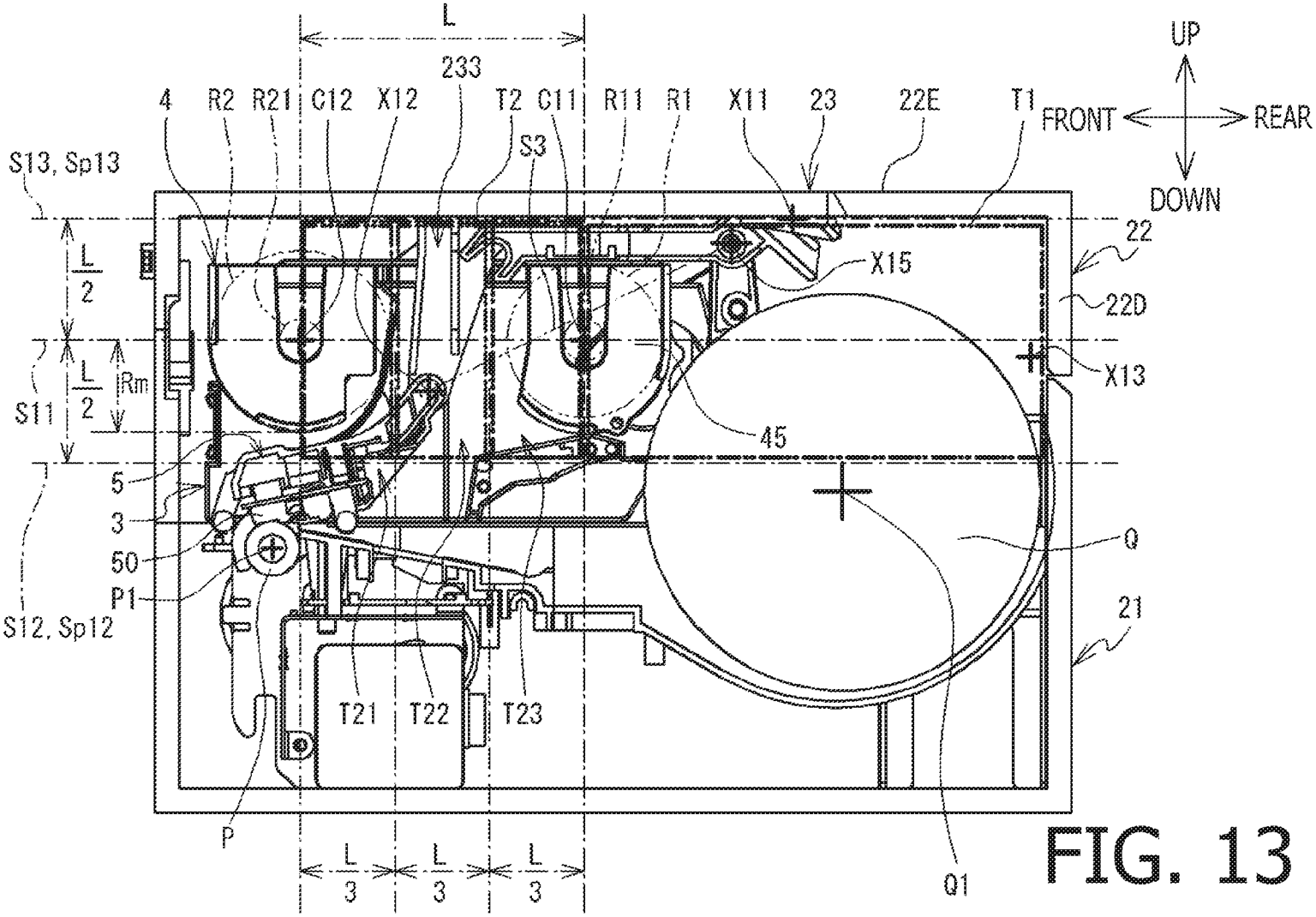

FIG. 13 is a cross-sectional view of the thermal-transfer printer 1A to illustrate relative positions of a first axis X11 and a second axis X12 according to the first embodiment of the present disclosure.

Figure 14:
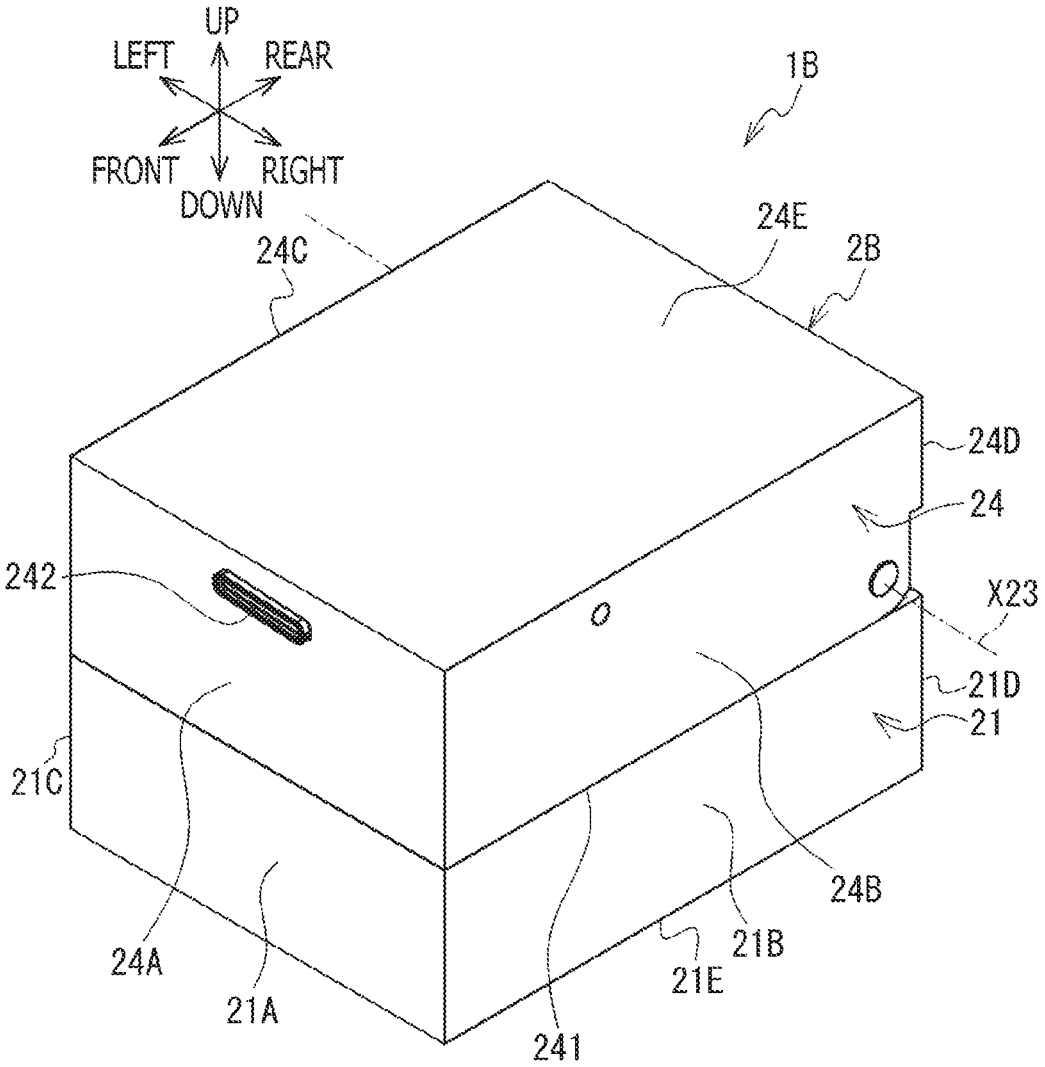

FIG. 14 is a perspective view of a thermal-transfer printer 1B according to a second embodiment of the present disclosure with a second case 24 at a third position (closed position).

Figure 15:
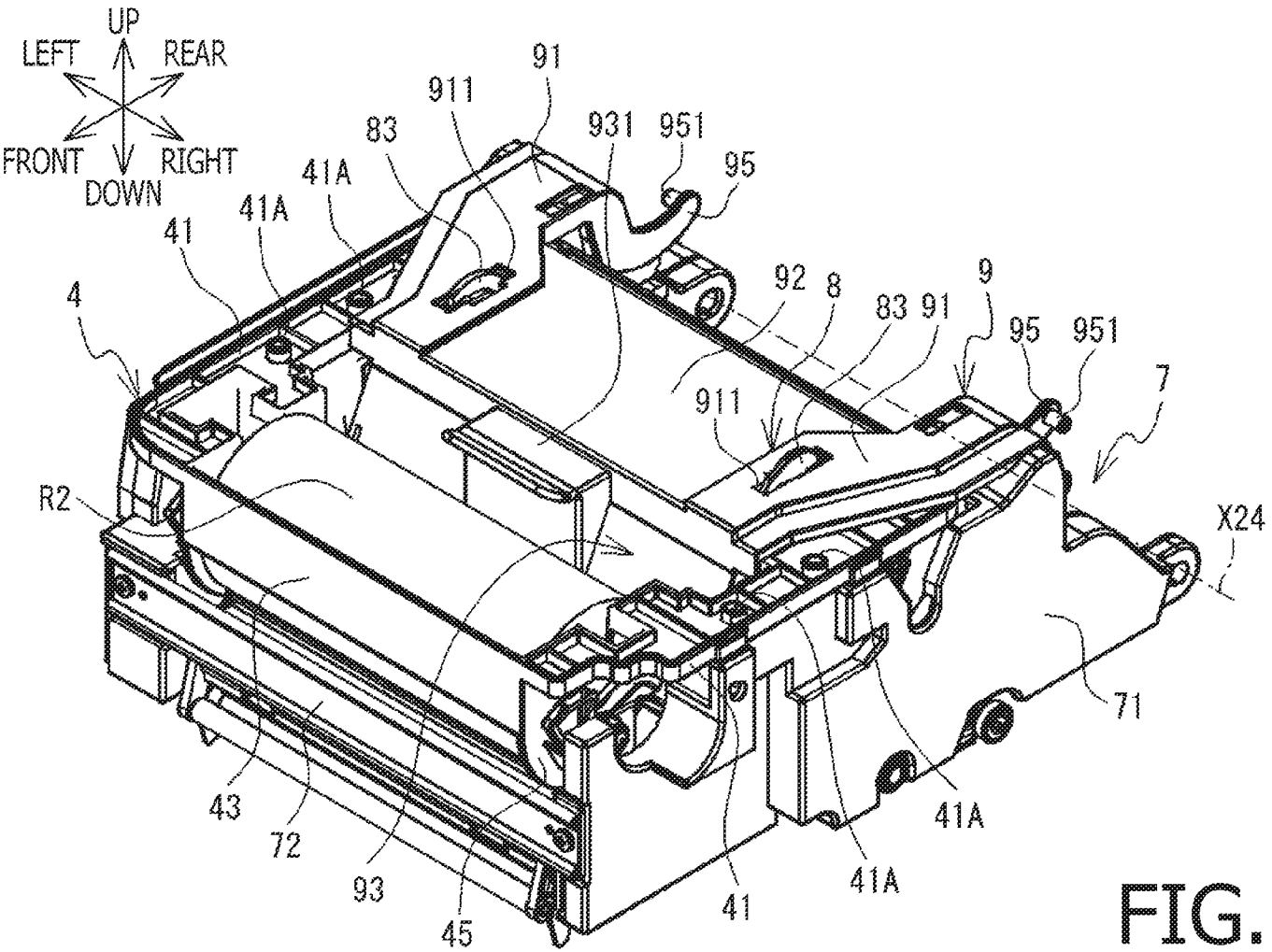

FIG. 15 is a perspective view of an ink ribbon supporting member 7 in a condition to be stored in the second case 24 in the thermal-transfer printer 1B according to the second embodiment of the present disclosure.

Figure 16:
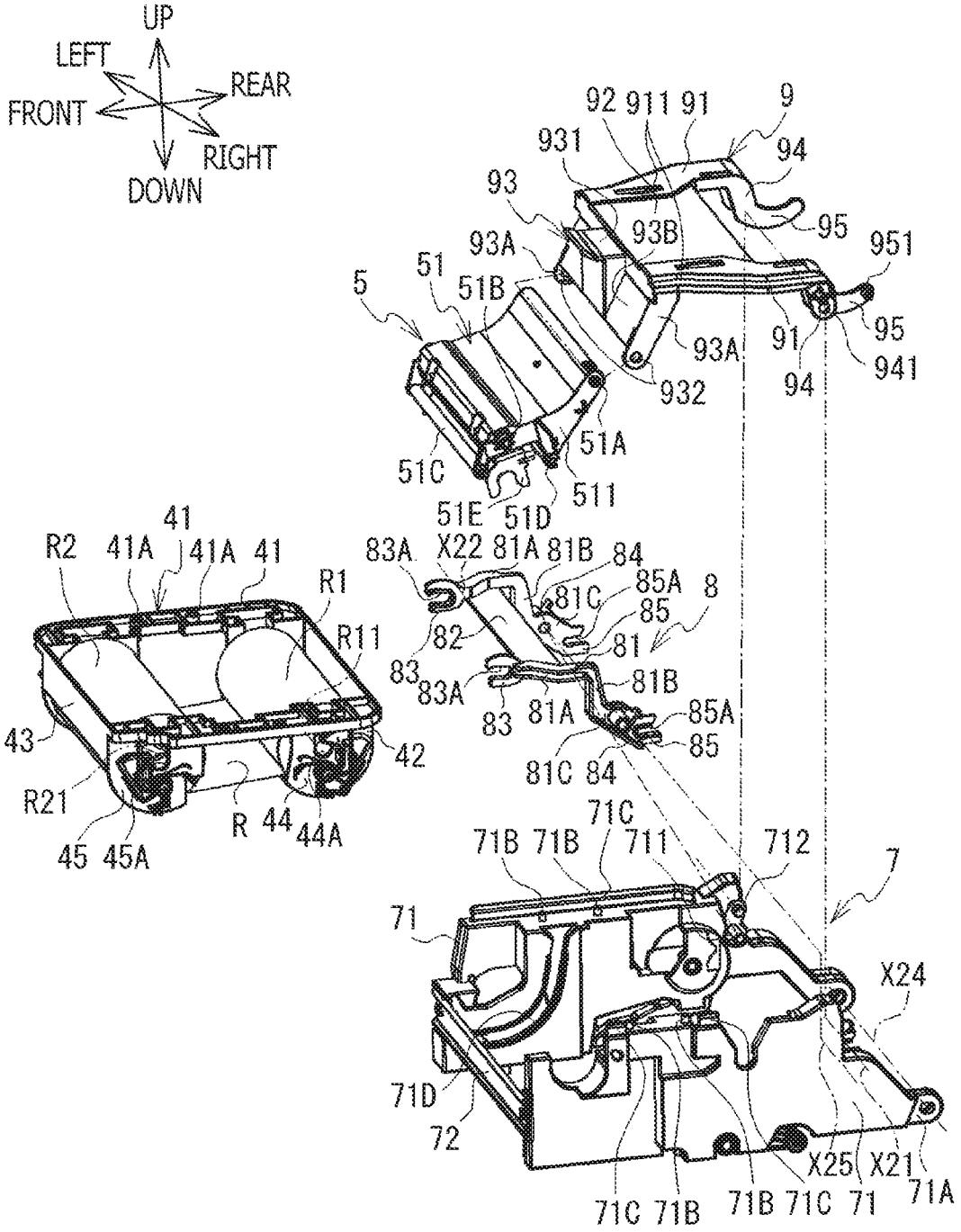

FIG. 16 is an exploded perspective view of the ink ribbon supporting member 7, a subsidiary arm 8, and a head arm 9 in the thermal-transfer printer 1B according to the second embodiment of the present disclosure.

Figure 17:
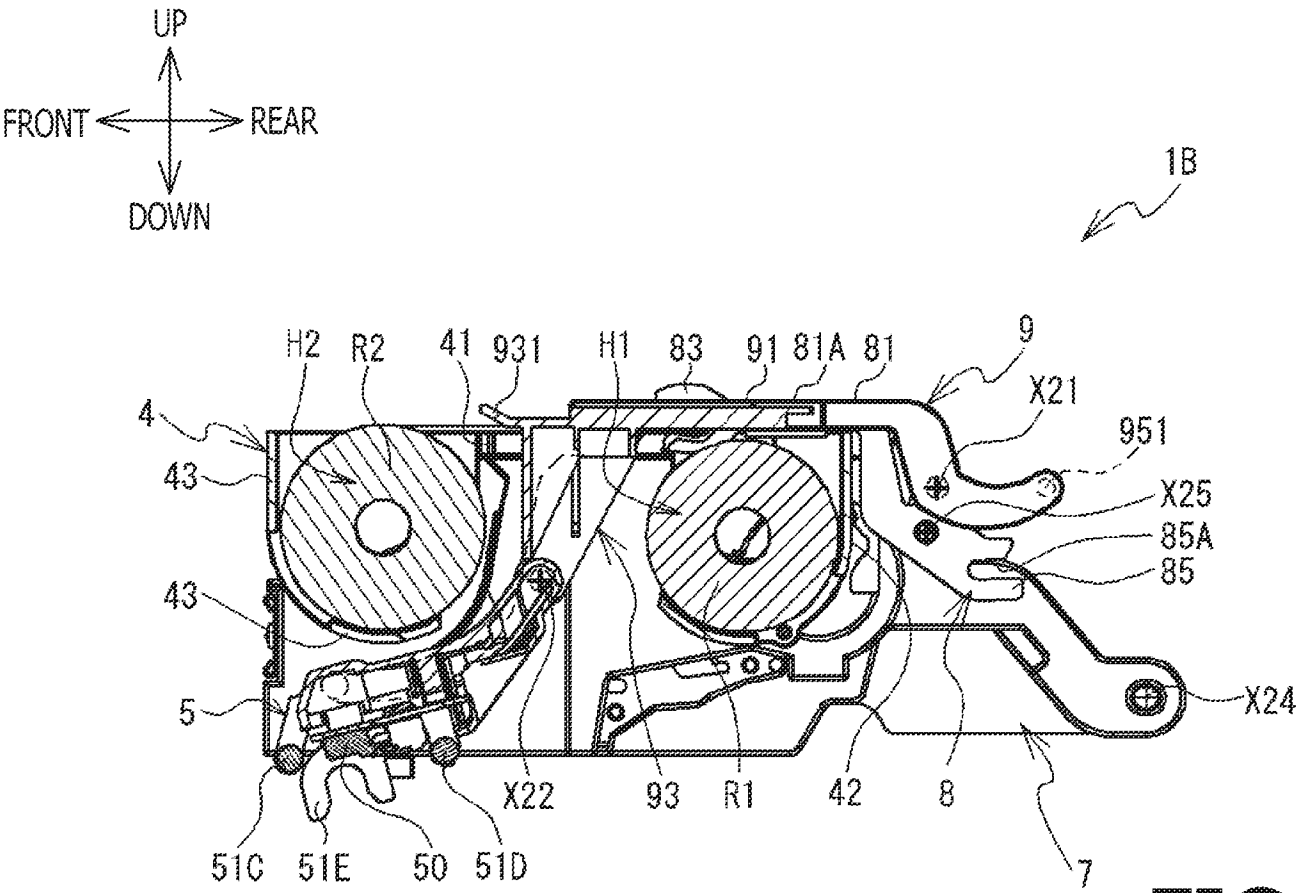

FIG. 17 is a sideward view of the ink ribbon supporting member 7 in the thermal-transfer printer 1B according to the second embodiment of the present disclosure with the head arm 9 at a first position.

Figure 18:
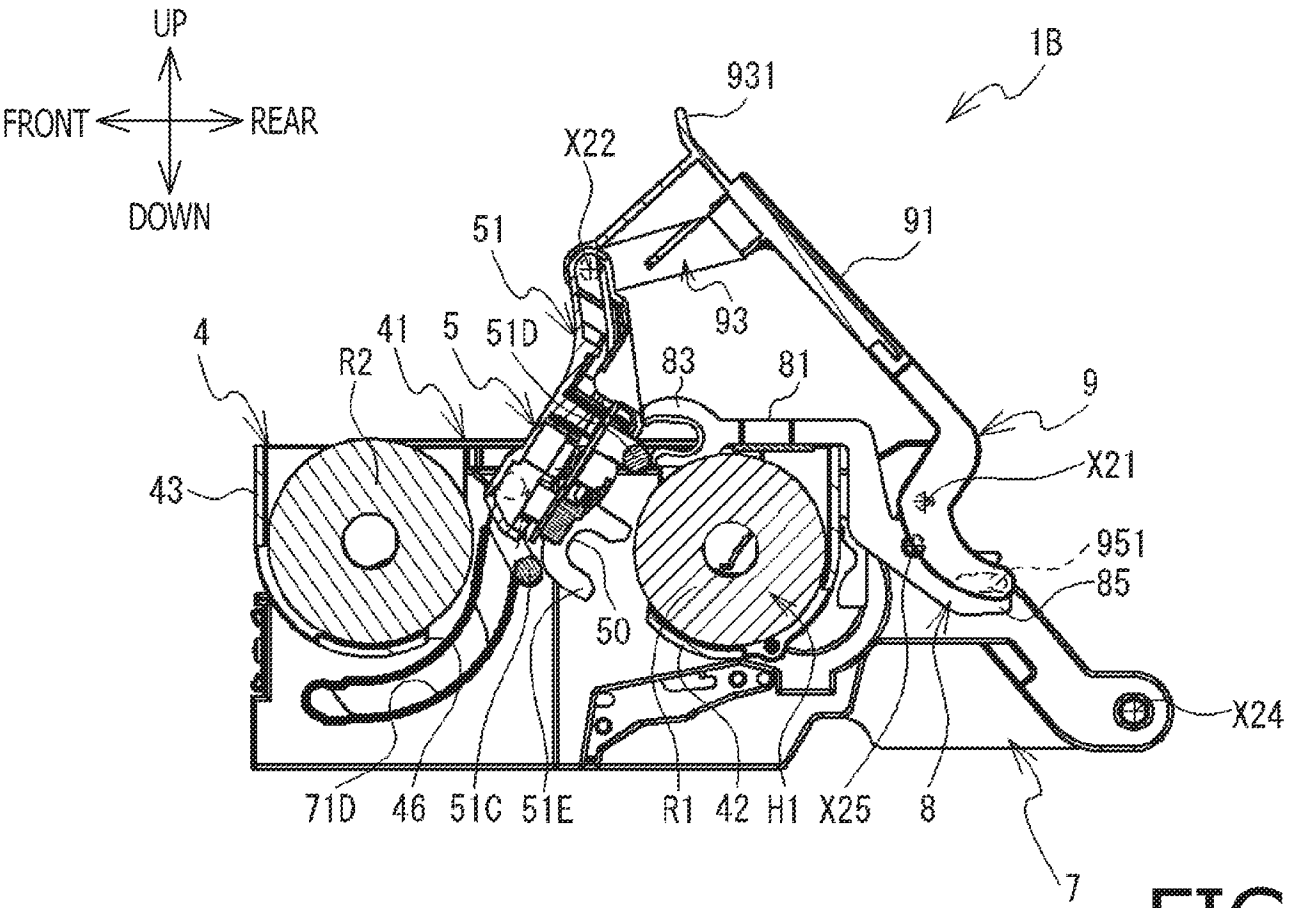

FIG. 18 is a sideward view of the ink ribbon supporting member 7 in the thermal-transfer printer 1B according to the second embodiment of the present disclosure with the head arm 9 at an interim position between the first position and a second position.

Figure 19:
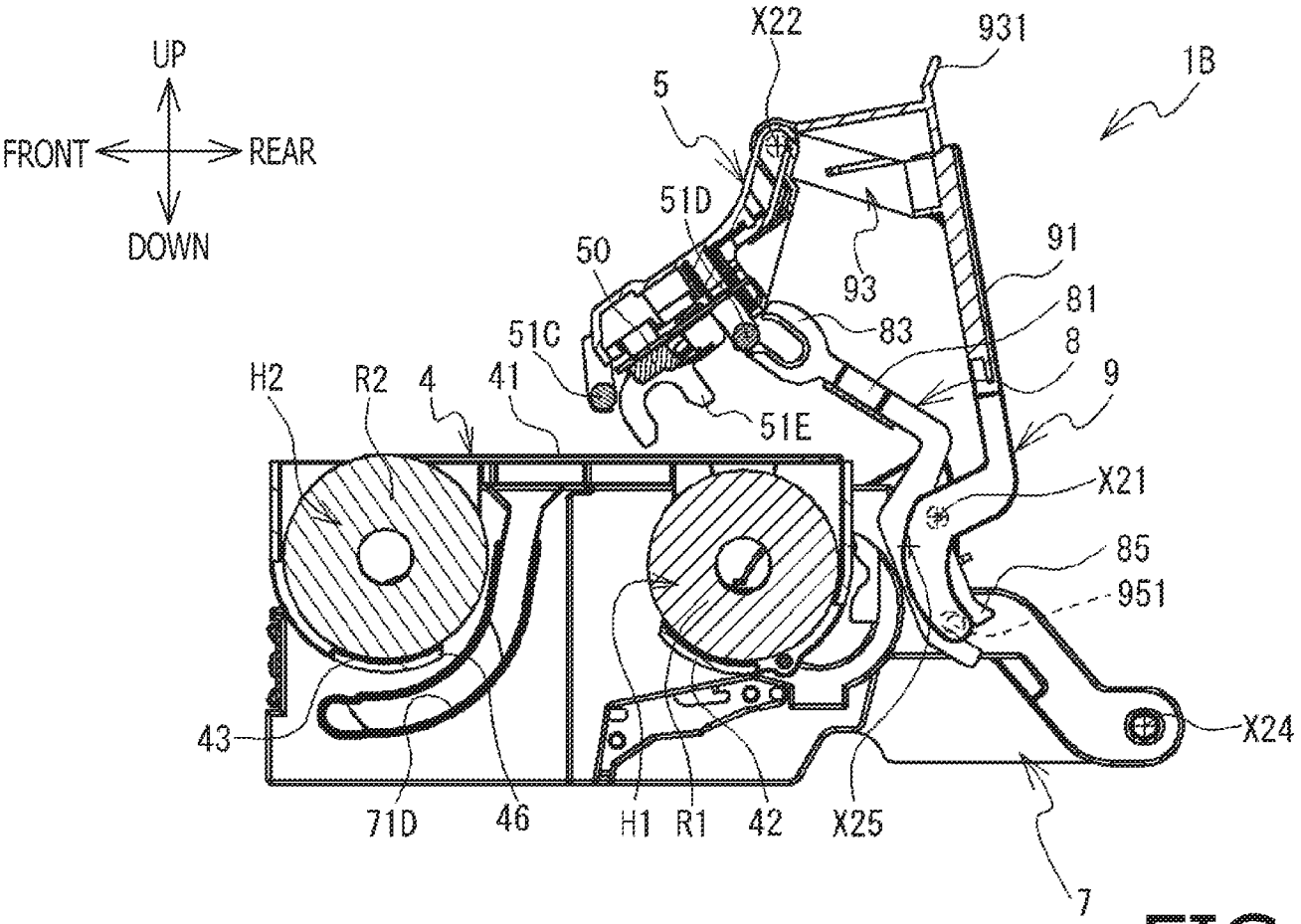

FIG. 19 is a sideward view of the ink ribbon supporting member 7 in the thermal-transfer printer 1B according to the second embodiment of the present disclosure with the head arm 9 at another interim position between the first position and a second position.

Figure 20:
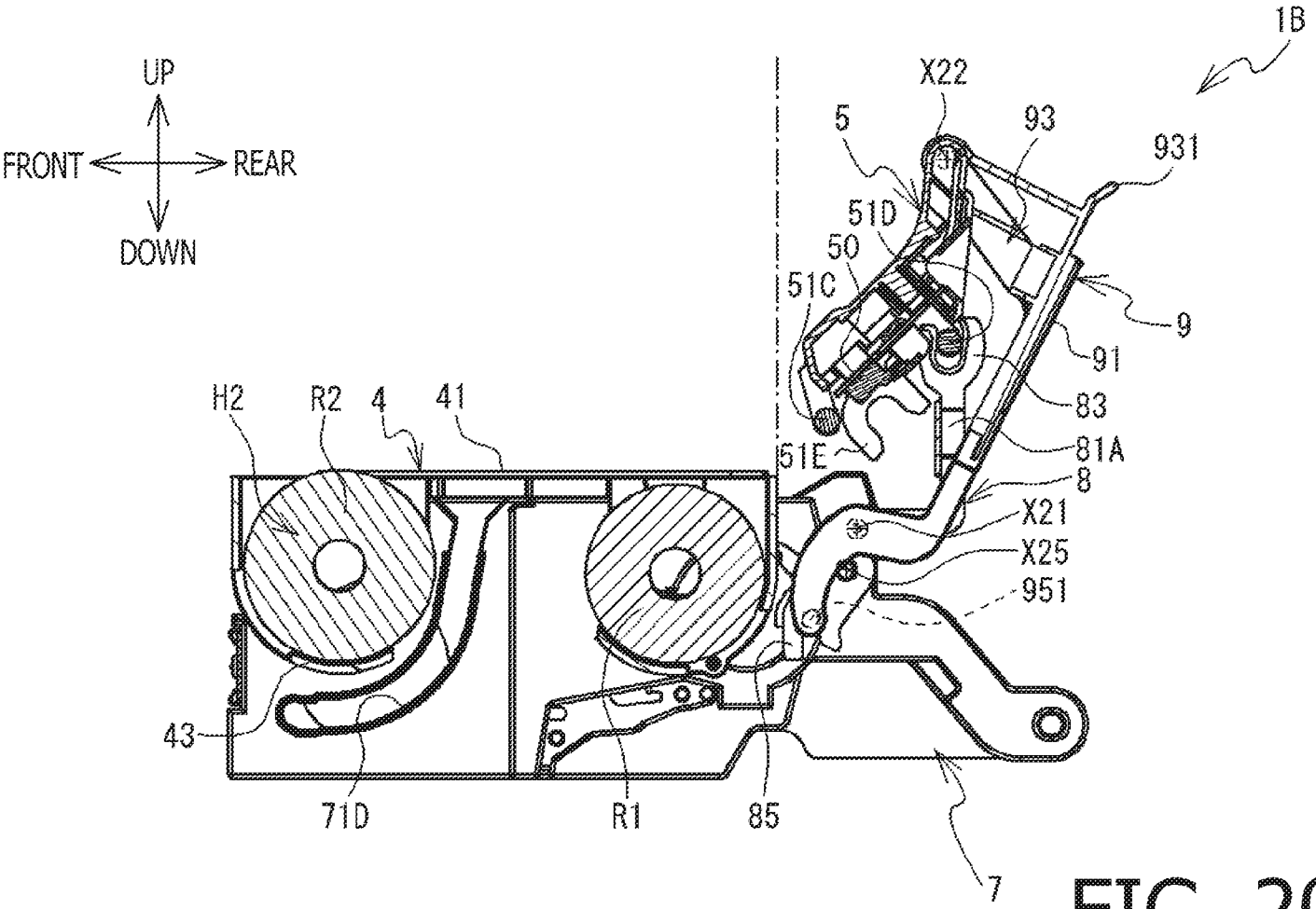

FIG. 20 is a sideward view of the ink ribbon supporting member 7 in the thermal-transfer printer 1B according to the second embodiment of the present disclosure with the head arm 9 at the second position.

Figure 21:
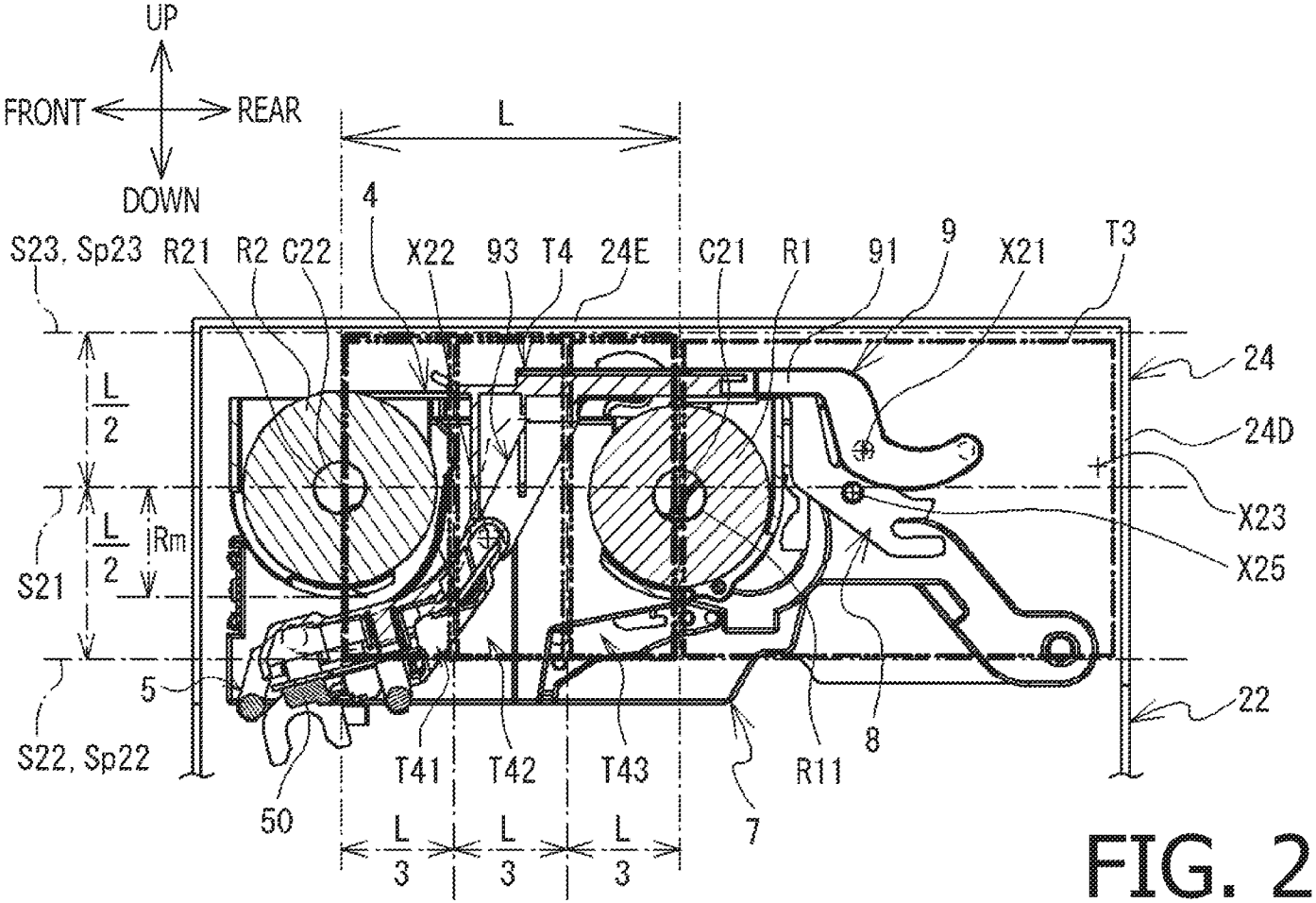

FIG. 21 is a cross-sectional view of the thermal-transfer printer 1B to illustrate relative positions of a first axis X21 and a second axis X22 according to the second embodiment of the present disclosure.

Figure 22:
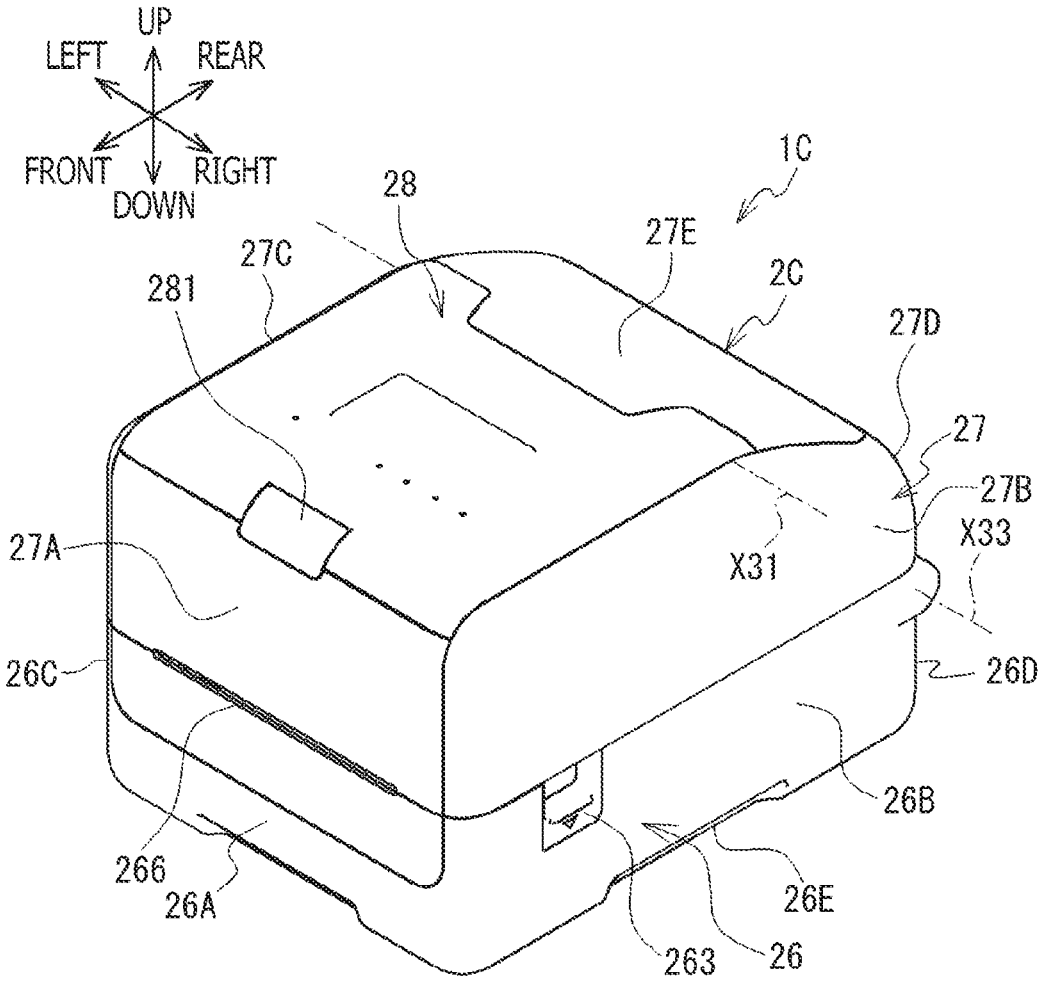

FIG. 22 is a perspective view of a thermal-transfer printer 1C according to a third embodiment of the present disclosure with a second case 27 at a third position (closed position) and a cover 28 at a first position (closed position).

Figure 23:
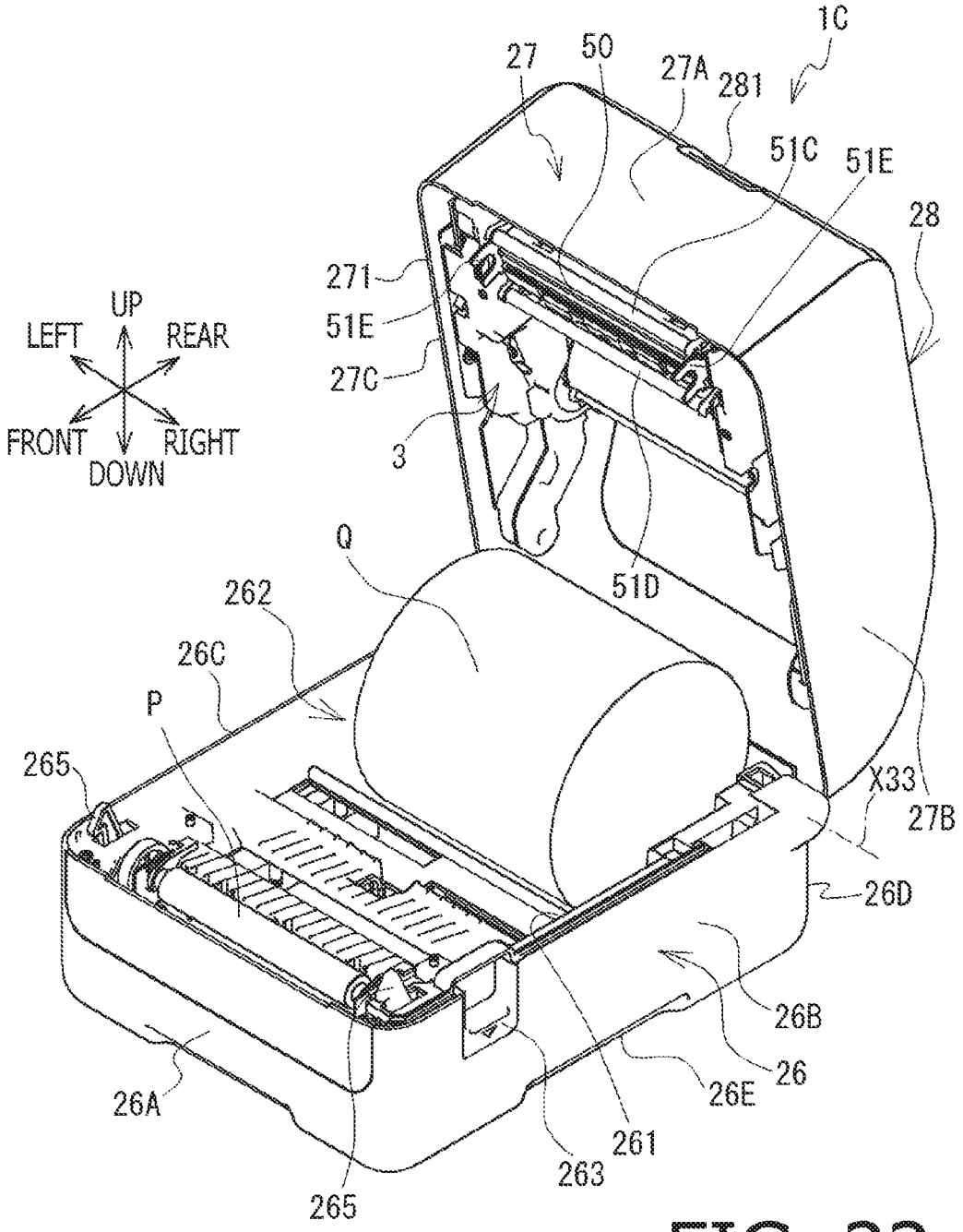

FIG. 23 is a perspective view of the thermal-transfer printer 1C according to the third embodiment of the present disclosure with the second case 27 at a fourth position (open position) and the cover 28 at the first position (closed position).

Figure 24:
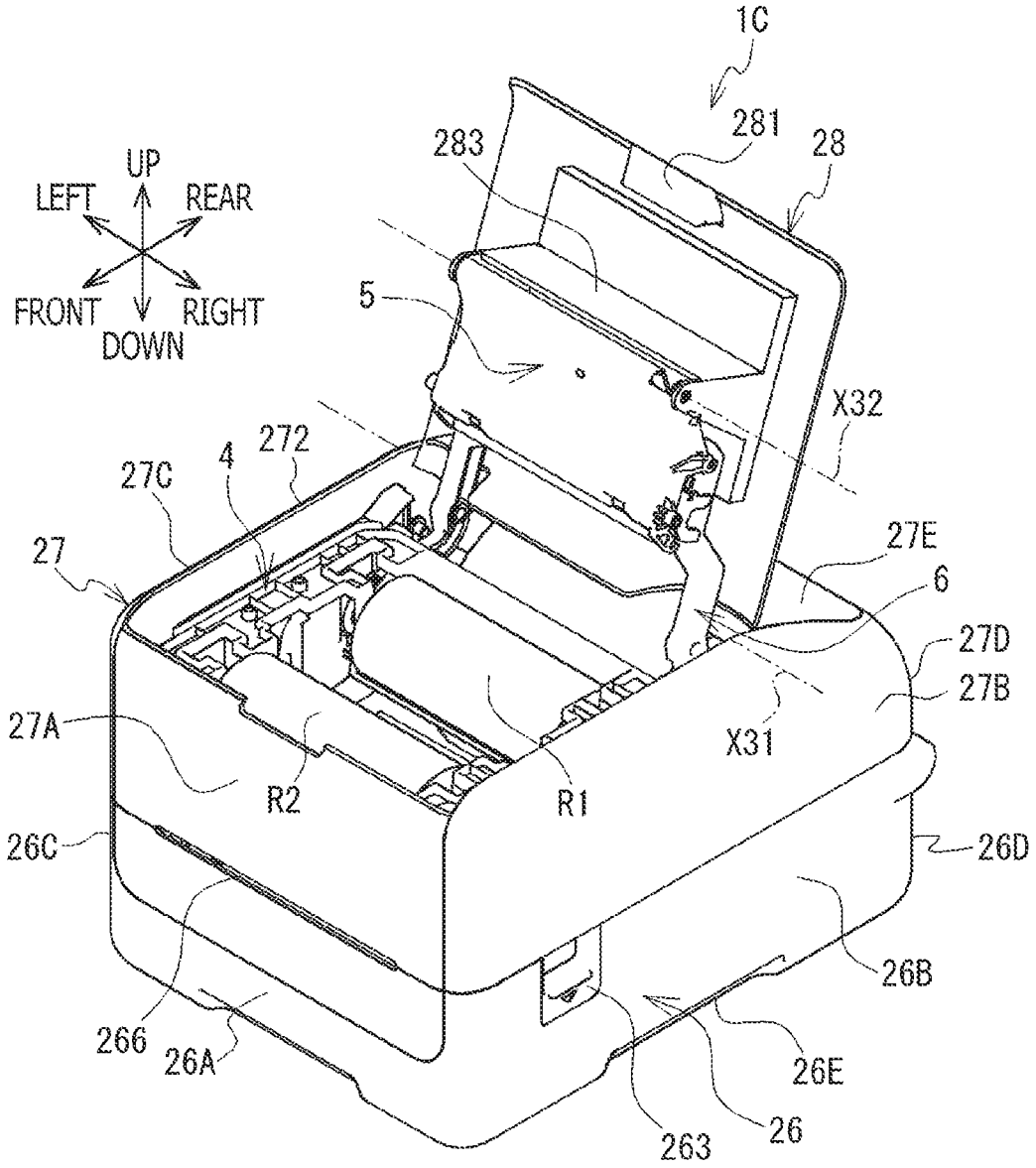

FIG. 24 is a perspective view of the thermal-transfer printer 1C according to the third embodiment of the present disclosure with the second case 27 at the third position (closed position) and the cover 28 at second position (open position).

Figure 25:
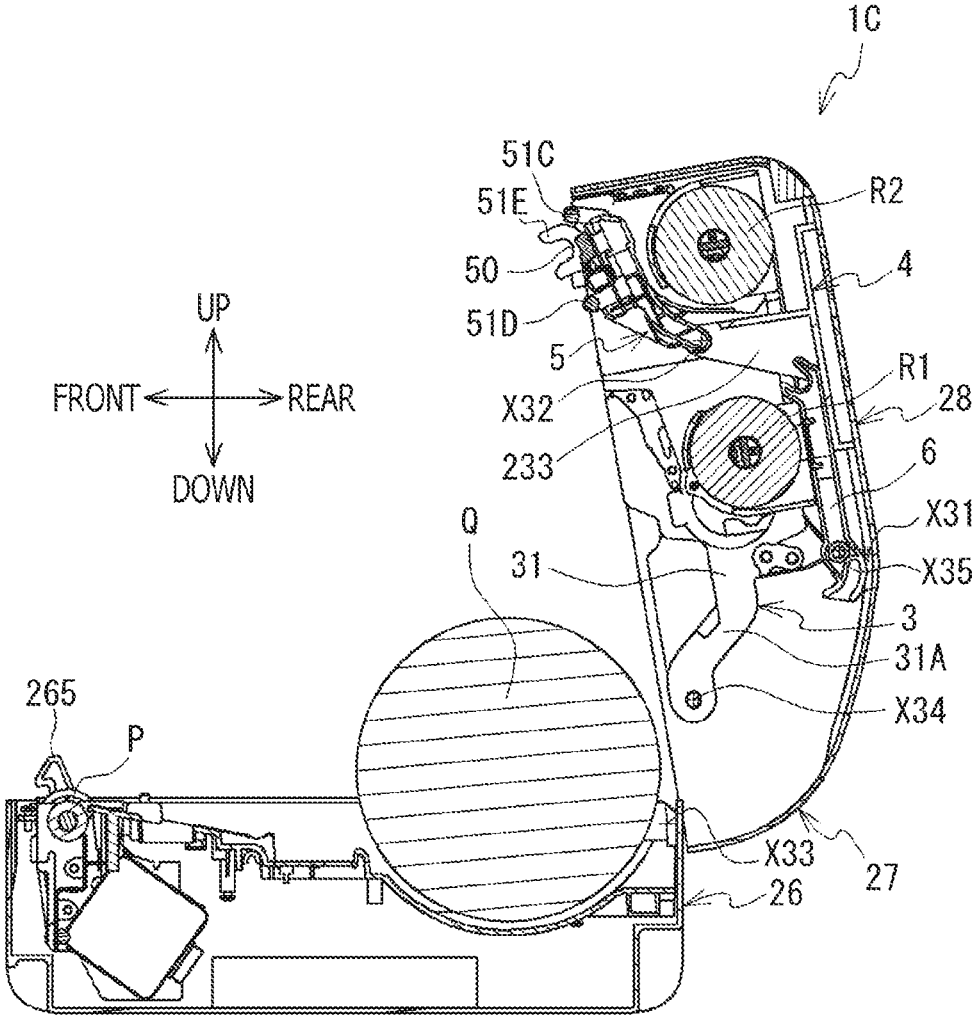

FIG. 25 is a cross-sectional view of the thermal-transfer printer 1C according to the embodiment of the present disclosure with the second case 27 at the fourth position (open position) and the cover 28 at the first position (closed position).

Figure 26:
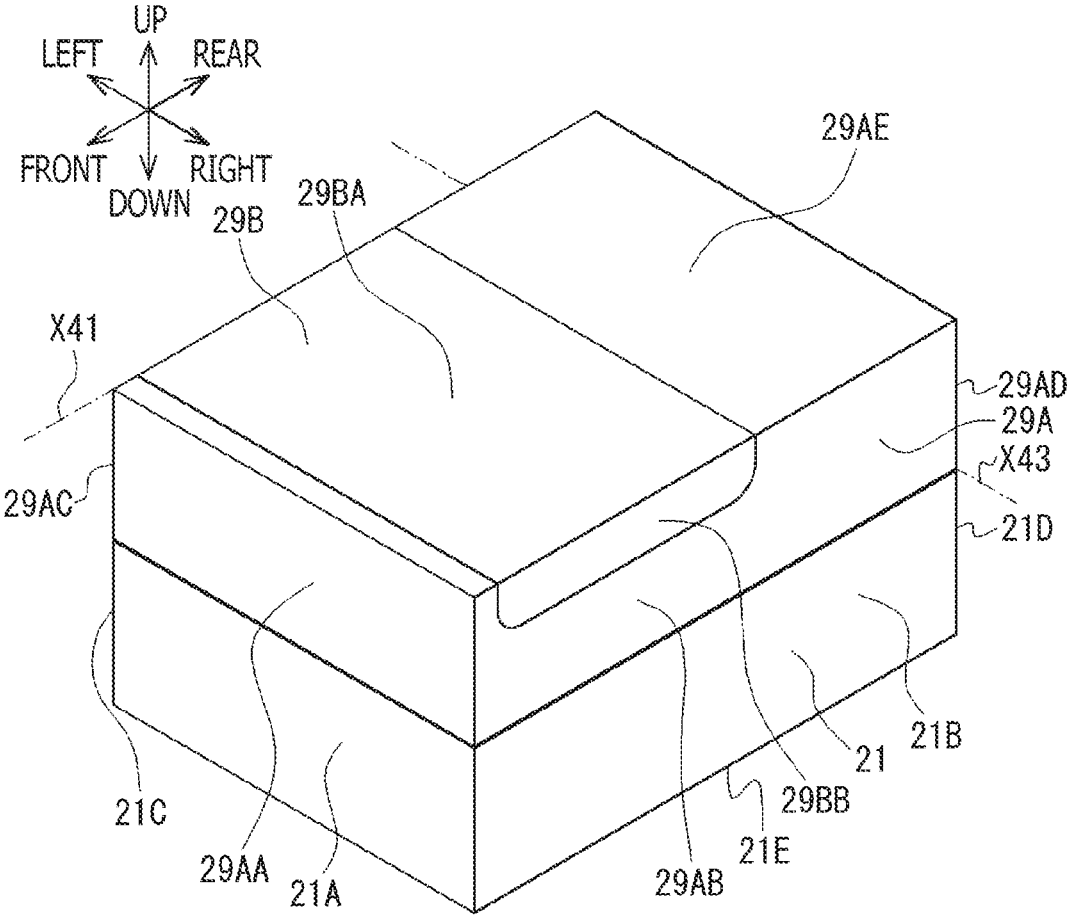

FIG. 26 is a perspective view of a thermal-transfer printer 1D according to a fourth embodiment of the present disclosure with a second case 29A at a third position (closed position) and a cover 29B at a first position (closed position).

Figure 27:
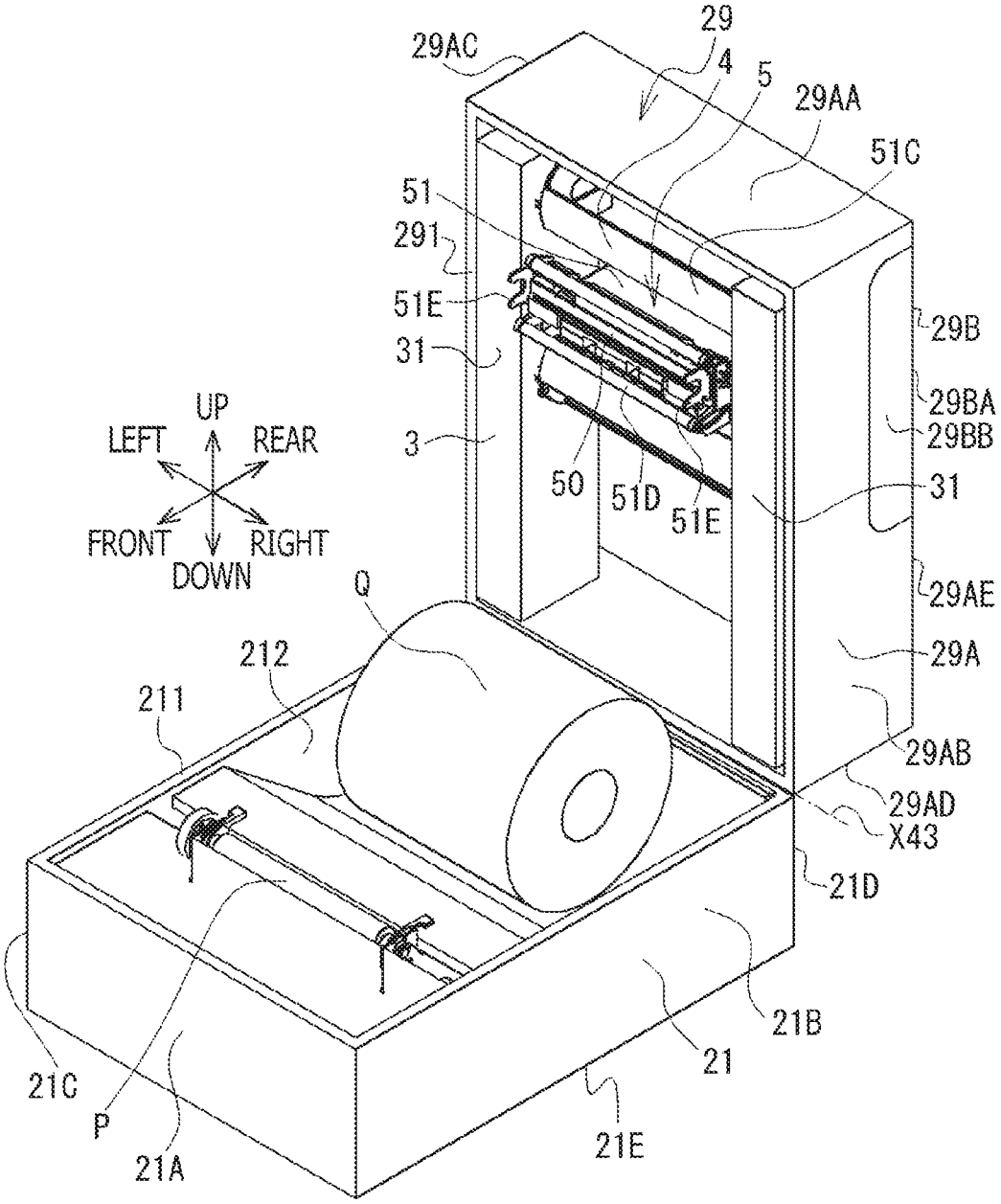

FIG. 27 is a perspective view of the thermal-transfer printer 1D according to the fourth embodiment of the present disclosure with the second case 29A at a fourth position (open position) and the cover 29B at the first position (closed position).

Figure 28:
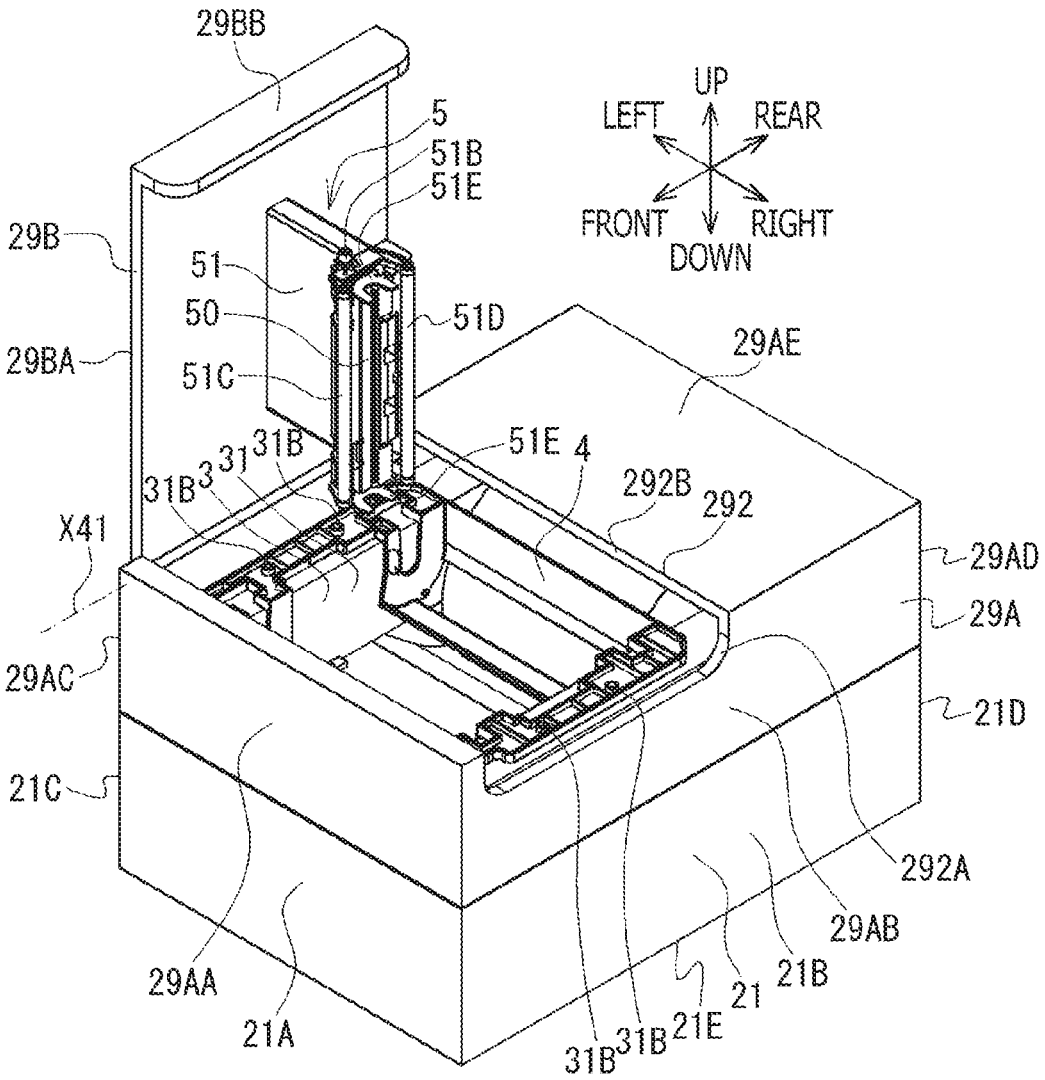

FIG. 28 is a perspective view of the thermal-transfer printer 1D according to the fourth embodiment of the present disclosure with the second case 29A at the third position (closed position) and the cover 29B at a second position (open position).

DETAILED DESCRIPTION

Hereinafter, embodiments of the present disclosure will be described with reference to the accompanying drawings.

First Embodiment

A thermal-transfer printer 1A according to a first embodiment of the present disclosure will be described in the following paragraphs. The thermal-transfer printer 1A may heat an ink ribbon R installed therein through a thermal head 50 to transfer ink on the ink ribbon R to a printing medium to print an image. In the following description, directions related the thermal-transfer printer 1A and parts and members included in the thermal-transfer printer 1A will be mentioned on basis of a posture of the thermal-transfer printer 1A with reference to arrows in each drawing. For example, in FIG. 1, sides of the thermal-transfer printer 1A on a viewer's lower-leftward direction, upper-rightward direction, lower-rightward direction, upper-leftward direction, upward direction, and downward direction correspond to a front side, a rear side, a right side, a left side, an upper side, and a lower side of the thermal-transfer printer 1A, respectively. A front-to-rear or rear-to-front direction may be expressed as a front-rear direction, an up-to-down or down-to-up direction may be expressed as a vertical direction, and a left-to-right or right-to-left direction may be expressed as a widthwise direction.

<Case 2A>

Figure 1:
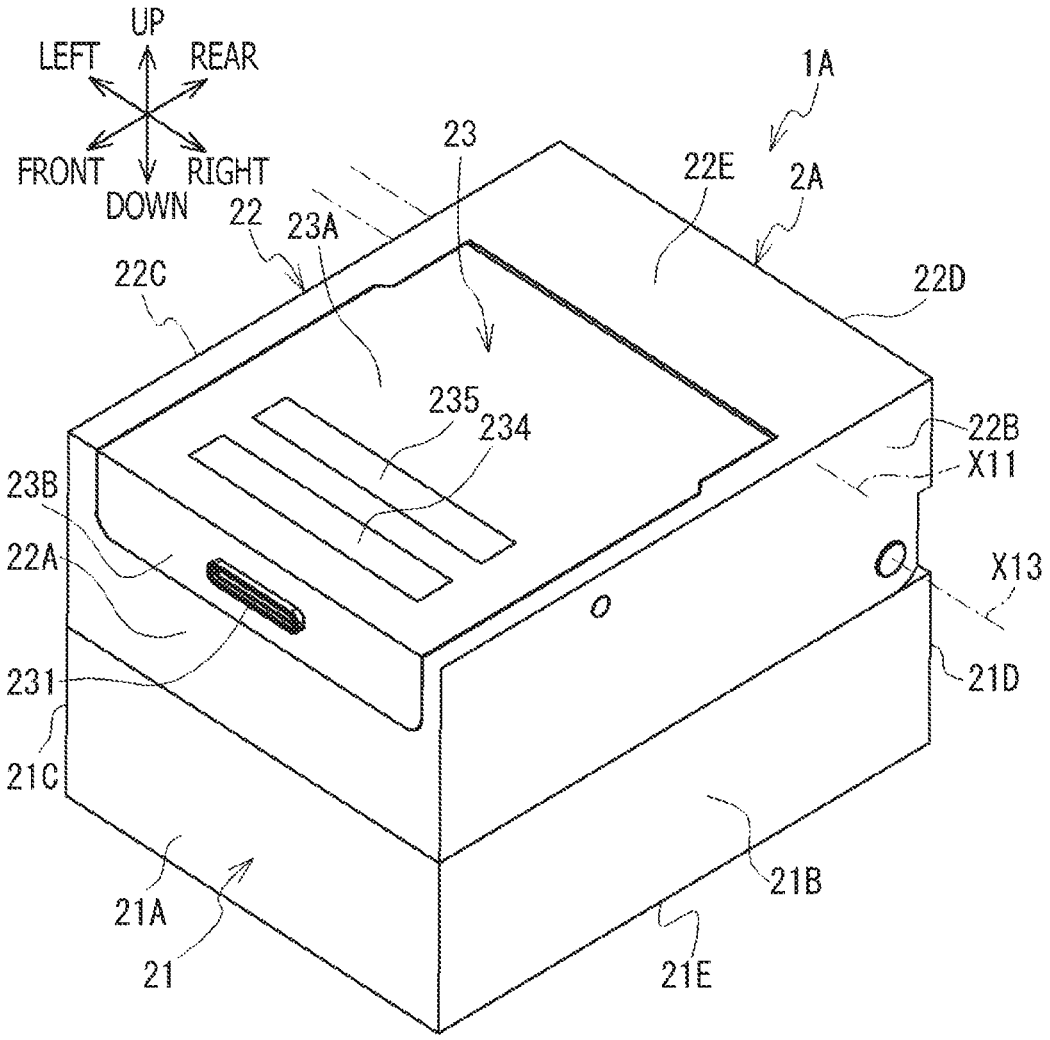
FIG. 1 is a perspective view of a thermal-transfer printer 1A according to a first embodiment of the present disclosure with a second case 22 at a third position (closed position) and a cover 23 at a first position (closed position).

As shown in FIG. 1, the thermal-transfer printer 1A includes a case 2A, which has an approximate shape of a rectangular box. The case 2A includes a first case 21, a second case 22, and a cover 23. The first case 21 has outer faces that form approximately lower halves of a frontward face, a rightward face, a leftward face, and a rearward face; and a bottom face of the thermal-transfer printer 1A. The second case 22 has outer faces that form approximately upper halves of the frontward face, the rightward face, the leftward face, and the rearward face; and a part of an upper face of the thermal-transfer printer 1A. An outer face of the cover 23 forms another part of the upper face of the thermal-transfer printer 1A. Thus, the first case 21, the second case 22, and the cover 23 form exterior faces of the thermal-transfer printer 1A.

Figure 2:
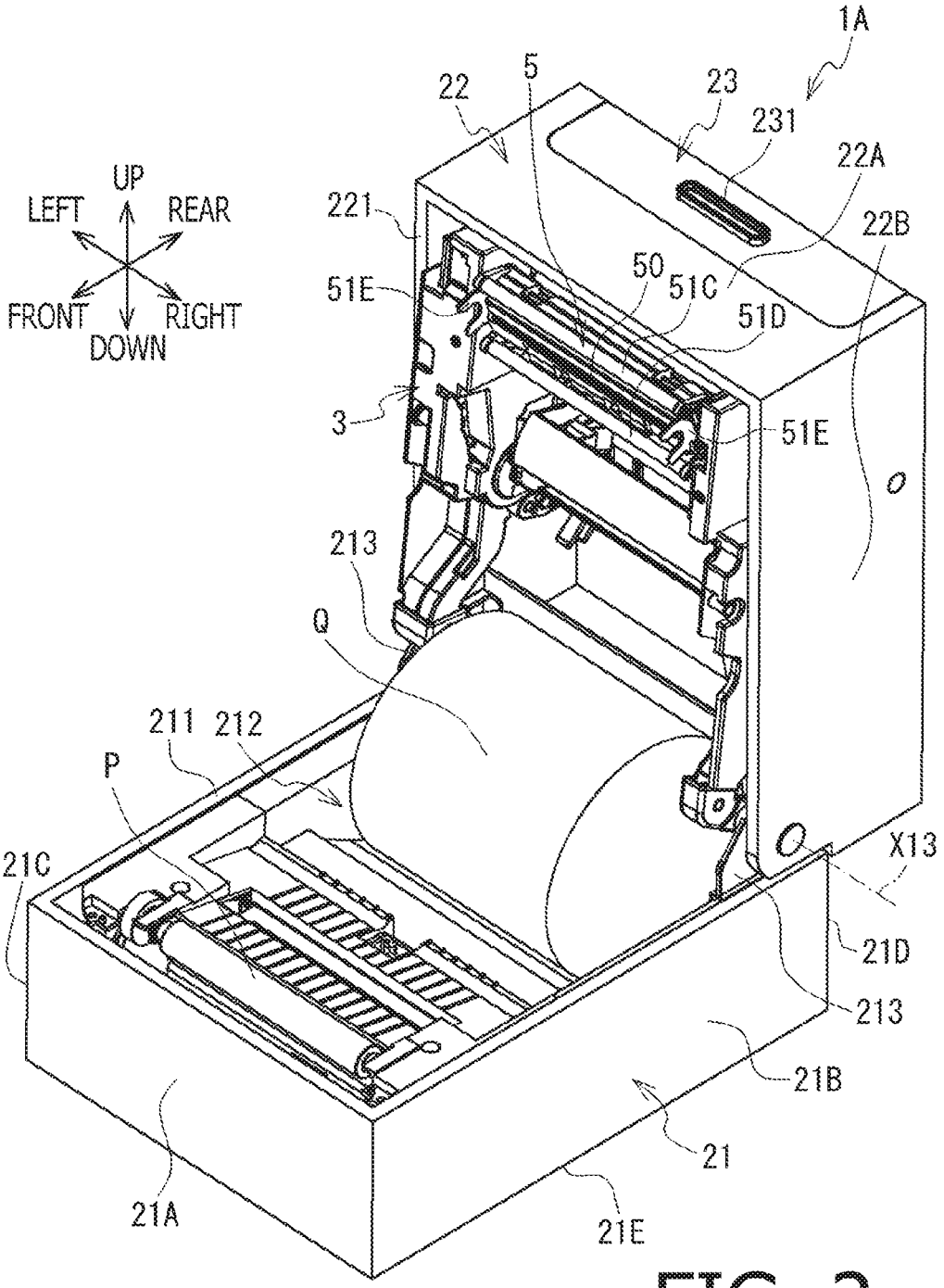
FIG. 2 is a perspective view of the thermal-transfer printer 1A according to the first embodiment of the present disclosure with the second case 22 at a fourth position (open position) and the cover 23 at the first position (closed position).

As shown in FIG. 2, the first case 21 includes walls 21A, 21B, 21C, 21D, 21E, which serve as a frontward wall, a rightward wall, a leftward wall, a rearward wall, and a bottom, respectively, of the first case 21. Upper ends of the walls 21A-21D form an opening 211 at an upper end of the first case 21. The first case 21 supports a platen roller P rotatably at a frontward position in an area enclosed by the walls 21A-21E. A rotation axis of the platen roller P extends in the widthwise direction. The first case 21 rotatably supports a medium roller Q, in which a printing medium in a form of a tape is wound into a roll, at a rearward position in the area enclosed by the walls 21A-21E. In the following paragraphs, the area inside the first case 21, in which the medium roll Q is stored, may be expressed as a medium storage 212.

The walls 21B, 21C each has a linkage 213 at a rearward position therein. The linkages 213, 213 protrude upward from upper ends of the walls 21B, 21C, respectively. The linkages 213 pivotably support the second case 22 and an ink ribbon supporting member 3, as will be described further below.

As shown in FIG. 1, the second case 22 is located at an upper position with respect to the first case 21. The second case 22 is movably supported by the linkages 213 on the first case 21 to pivot about a third axis X13, which extends in the widthwise direction. The second case 22 may pivot to open or close the opening 211 of the first case 21. FIG. 1 shows the second case 22 covering the opening 211 of the first case 21. In the following paragraphs, the position of the second case 22 covering the opening 211 as shown in FIG. 1 may be expressed as a third position (closed position). Meanwhile, FIG. 2 shows the second case 22 uncovering the opening 211 of the first case 21. In the following paragraphs, the position of the second case 22 uncovering the opening 211 as shown in FIG. 2 may be expressed as a fourth position (open position). In the following paragraphs, unless otherwise noted, directions related to the second case 22 will be based on the posture of the second case 22 being at the third position (closed position), as shown in FIG. 1 and as indicated by the arrows in FIG. 1.

Figure 3:
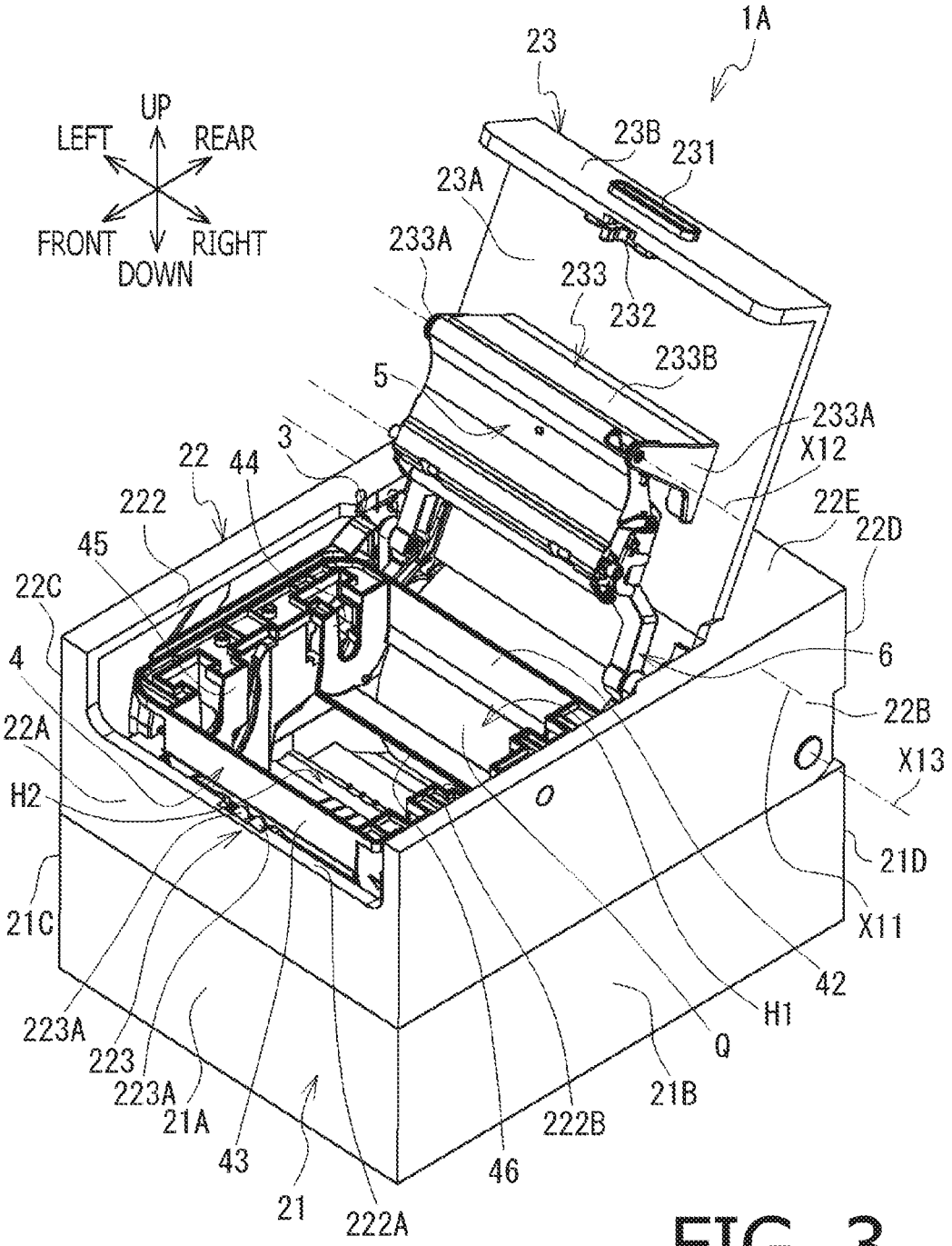
FIG. 3 is a perspective view of the thermal-transfer printer 1A according to the first embodiment of the present disclosure with the second case 22 at the third position (closed position) and the cover 23 at a second position (open position).

The second case 22 includes walls 22A, 22B, 22C, 22D, 22E, which serve as parts of a frontward wall, a rightward wall, a leftward wall, a rearward wall, and an upper wall, respectively, of the second case 22. Lower ends of the walls 22A-22D form an opening 221 (see FIG. 2) at a lower end of the second case 22. As shown in FIG. 3, a recessed portion 222A formed at an upper-end area in the wall 22A and a recessed portion 222B formed at a frontward area in the wall 22E form an opening 222 in the second case 22. The opening 222 is located in an upper area in the second case 22, when the second case 22 is at the third position (closed position). When the second case 22 is at the third position (closed position) to cover the opening 211 of the first case 21, the opening 211 at the upper end of the first case 21 and the opening 221 at the lower end of the second case 22 are connected to be at least partly continuous with each other.

As shown in FIG. 1, when the second case 22 is at the third position (closed position), a frontward surface of the wall 21A, a rightward surface of the wall 21B, a leftward surface of the wall 21C, a rearward surface of the wall 21D align flat on same vertical planes with a frontward surface of the wall 22A, a rightward surface of the wall 22B, a leftward surface of the wall 22C, and a rearward surface of the wall 22D, respectively, without forming different-leveled tiers. In other words, at joints between the wall 21A and the wall 22A, between the wall 21B and the wall 22B, between the wall 21C and the wall 22C, and between the wall 21D and the wall 22D, no substantial difference in depth or width is caused.

As shown in FIG. 3, the second case 22 has a locking device 223 at an upper end of the recessed portion 222A in the wall 22A. The locking device 223 includes two (2) locking members 223A, which are separated from each other in the widthwise direction but urged inward to be closer to each other.

The second case 22 may store an ink ribbon supporting member 3 and a cartridge case 4 therein. The ink ribbon supporting member 3 may be pivotably supported by the linkages 213 in the first case 21, and the cartridge case 4 may be attached to the ink ribbon supporting member 3. The ink ribbon supporting member 3 and the cartridge case 4 will be described further below.

As shown in FIGS. 1-3, the cover 23 may open or close the opening 222 of the second case 22. The cover 23 is movably supported by the second case 22 to pivot with respect to the second case 22 about a first axis X11, which extends in the widthwise direction through a rearward area with respect to the opening 222. The first axis X11 is located at a frontward position with respect to the third axis X13, which is the pivot axis for the second case 22. As shown in FIGS. 1 and 2, the cover 23 may cover and close the opening 222 of the second case 22. In the following paragraphs, the position of the cover 23 covering the opening 222 as shown in FIGS. 1 and 2 may be expressed as a first position (closed position). Meanwhile, as shown in FIG. 3, the cover 3 may open and uncover the opening 222 of the second case 22. In the following paragraphs, the position of the cover 23 uncovering the opening 222 as shown in FIG. 3 may be expressed as a second position (open position).

The second position (open position) for the cover 23 is, when the second case 22 is at the third position (closed position) (see FIG. 3), a position higher than the first position (closed position). In other words, the first position (closed position) is closer to the second case 22, and the second position (open position) is farther from the second case 22. While the cover 23 is at the second position (open position), and while the ink ribbon supporting member 3 is stored in the second case 22 (see FIG. 3), the cartridge case 4, as will be described further below, is exposed to the outside through the opening 222. While the cover 23 is at the first position (closured position) (see FIG. 1), the cartridge case 4 is covered by the cover 23 from an upper side: in other words, the cover 23 covers an upper side of the cartridge case 4. In the following paragraphs, unless otherwise noted, directions related to the cover 23 will be based on the posture of the cover 23 being at the first position (closed position) while the second case 22 is at the third position (closed position), as shown in FIG. 1 and as indicated by the arrows in FIG. 1.

As shown in FIG. 1, the cover 23 includes walls 23A, 23B. The wall 23A has a shape substantially identical with an outline of the recessed portion 222A (see FIG. 3) in the second case 22. The wall 23A is pivotably supported by the second case 22 at a rearward end portion thereof. The wall 23B has a shape substantially identical with an outline of the recessed portion 222B (see FIG. 3) in the second case 22. The wall 23B extends, in a posture where the cover 23 is at the first position (closed position), downward from a front end of the wall 23A. In other words, a frontward portion of the cover 23 bends downward in the posture where the cover 23 is at the first position (closed position).

On a frontward face of the wall 23B in the cover 23, arranged is a handle 231 protruding frontward. As shown in FIG. 3, at a lower end of the wall 23B, arranged is a protrusion 232 protruding downward. The protrusion 232 is, when the cover 23 is at the first position (closed position) (see FIG. 1), located between the two locking members 223A in the locking device 223 in the second case 22. While the locking members 223A are urged inward, the protrusion 232 arranged between the locking members 223A is restricted from separating from the locking members 223A. Therefore, the cover 23 may stay at the first position (closed position) without pivoting to the second position (open position).

As shown in FIG. 1, the cover 23 has an operation interface 234 and a display 235 on an upper face of the wall 23A. The operation interface 234 includes buttons (not shown), through which commands from a user may be entered. The display 235 includes a displaying device such as, for example, an organic electro luminescence (EL). The display 235 may include a touch panel.

As shown in FIG. 3, on a lower face, i.e., an inner face, of the wall 23A of the cover 23, arranged is a linkage 233. The linkage 233 protrudes downward from the lower face of the wall 23A at a central position in the front-rear direction in the cover 23. The linkage 233 includes two (2) side plates 233A, which are spaced apart from each other in the widthwise direction, and a bridged portion 233B, which extends between the side plates 233A. The side plates 233A spread orthogonally to the widthwise direction. At a lower end of each side plate 233A, bored through in the widthwise direction is a hole (unsigned). The linkage 233 pivotably supports a head holder 5, as will be described further below, at the lower ends of the side plates 233A.

<Head Holder 5 and Thermal Head 50>

Figure 4:
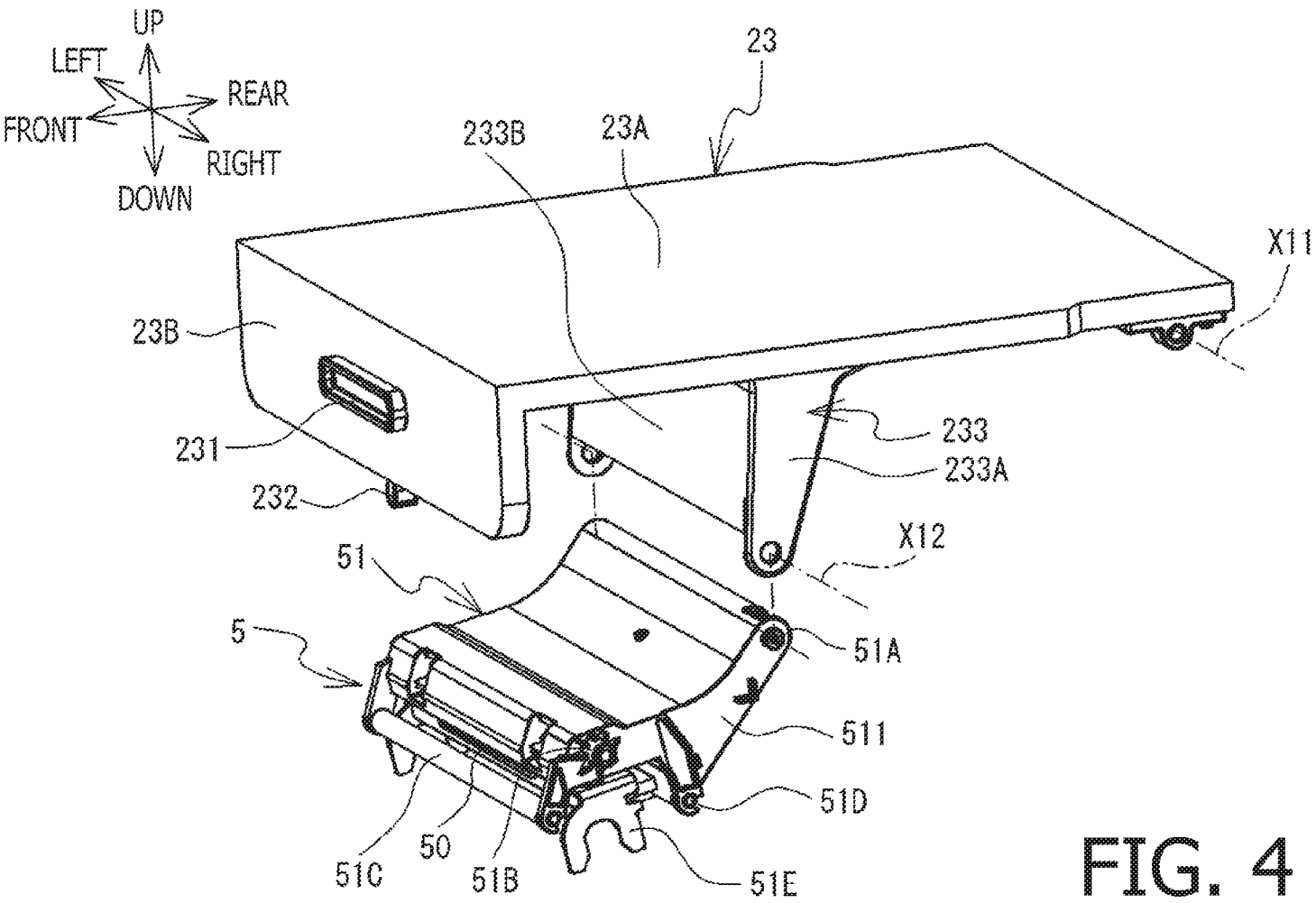
FIG. 4 is an exploded perspective view of the cover 23 and a head holder 5 in the thermal-transfer printer 1A according to the first embodiment of the present disclosure.

As shown in FIG. 4, the head holder 5 includes a base 51, two (2) protrusive portions 51A, two (2) protrusive portions 51B, conveyer rollers 51C, 51D, and two (2) fitting portions 51E. The base 51 has sidewalls 511, which spread orthogonally to the widthwise direction, at widthwise ends thereof. At a widthwise end of each sidewall 511, arranged is the protrusive portion 51A, which protrudes outward in the widthwise direction. The protrusive portions 51A are inserted outward in the widthwise direction into the holes formed in the side plates 233A in the linkage 233. The base 51 is pivotably supported by the cover 23 at end areas on one side thereof in the front-rear direction. The base 51 may pivot about a second axis X12, which extends in the widthwise direction through the holes formed in the side plates 233A. At end areas on a side opposite to the protrusive portions 51A in the front-rear direction in the sidewalls 511, arranged are the protrusive portions 51B protruding outward in the widthwise direction.

The head holder 5 may pivot about the second axis X12 in conjunction with the cover 23 moving between the first position (closed position) and the second position (open position). FIG. 4 shows a posture of the head holder 5 when the second case 22 is at the third position (closed position) and the cover 23 is at the first position (closed position) (see FIG. 1). In the following paragraphs, unless otherwise noted, directions related to the head holder 5 will be based on the posture of the cover 23 being at the first position (closed position) while the second case 22 is at the third position (closed position), as shown in FIG. 1 and as indicated by the arrows in FIG. 4.

The base 51 holds the thermal head 50 on a lower face thereof at a lower position with respect to the protrusive portions 51B. The thermal head 50 extends longitudinally in the widthwise direction between the sidewalls 511. The thermal head 50 may be a liner thermal head, which has a plurality of heating elements aligned in line in the widthwise direction on a heater surface thereof. In the posture shown in FIG. 4, the heater surface of the thermal head 50 faces downward. The base 51 has the fitting portions 51E at the widthwise ends thereof. The fitting portions 51E are plate members each having a recessed area. The recessed area is formed to recess upward from a lower end of each fitting portion 51E.

The base 51 holds the conveyer roller 51C and the conveyer roller 51D at a frontward position and a rearward position with respect to the thermal head 50, respectively. In other words, the conveyer roller 51C and the conveyer roller 51D are located in proximity to the thermal head 50, on a frontward side and a rearward side of the thermal head 50, respectively. The conveyer roller 51D is arranged on the base 51 at a position between a location of the thermal head 50 and a position of the protrusive portions 51A, which is the position of the second axis X12. The conveyer rollers 51C, 51D each has a cylindrical shape extending in the widthwise direction. The conveyer rollers 51C, 51D are rotatably supported by the base 51.

<Ink Ribbon Supporting Member 3>

As shown in FIG. 3, to the ink ribbon supporting member 3, the cartridge case 4 may be attached from an upper side. The cartridge case 4 holds ribbon rolls R1, R2 (see FIG. 5), which are rolls of an ink ribbon R (see FIG. 5). In other words, to the ink ribbon supporting member 3, the ink ribbon R rolled into the ribbon rolls R1, R2 and held by the cartridge case 4 is attachable.

The ink ribbon supporting member 3 is stored in the second case 22 and attached to an interior of the second case 22. In particular, the ink ribbon supporting member 3 may be supported pivotably by the linkage 213 in the first case 21 (see FIGS. 2 and 3). FIG. 2 shows the ink ribbon supporting member 3 stored in the second case 22, which is at the fourth position (open position). FIG. 3 shows the ink ribbon supporting member 3 stored in the second case 22, which is at the third position (closed position). In the following paragraphs, unless otherwise noted, directions related to the ink ribbon supporting member 3 will be based on the posture of the ink ribbon supporting member 3 stored in the second case 22 being at the third position (closed position), as shown in FIG. 3 and as indicated by the arrows in FIG. 3.

As shown in FIGS. 2 and 3, the ink ribbon supporting member 3 may be stored inside the second case 22. When the second case 22 is at the third position (closed position), a part of the ink ribbon supporting member 3 in a rearward area is located to be higher than the medium storage 212 (see FIG. 2) in the first case 21 (see FIG. 6). Meanwhile, another part of the ink ribbon supporting member 3 in a frontward area is located to be lower than the cover 23 (see FIG. 1) being at the first position (closed position) (see FIG. 6).

As shown in FIG. 5, the ink ribbon supporting member 3 includes two (2) sidewalls 31 and a bridged portion 32. The sidewalls 31 each has a shape of a plate spreading orthogonally to the widthwise direction and are spaced apart from each other in the widthwise direction. A distance between the sidewalls 31 is substantially equal to a distance between the walls 22B, 22C (see FIG. 3) of the second case 22. The sidewalls 31 on the right and the left are located in proximity to inner surfaces of the wall 22B and the wall 22C, respectively (see FIG. 3). The bridged portion 32 extends between frontward portions of the sidewalls 31.

Each sidewall 31 has an extended portion 31A, which extends upper-rearward from a rearward area in the sidewall 31. Rearward ends of the extended portions 31A are connectable with the linkages 213 (see FIG. 2) in the first case 21 pivotably to pivot about a fourth axis X14, which extends in the widthwise direction. Meanwhile, a position of the fourth axis X14 is different from the position of the third axis X13 (see FIG. 2), which is the pivot axis for the second case 22 pivotably supported by the linkages 213.

On an upper edge of each sidewall 31, at frontward positions with respect to a center of the sidewall 31 in the front-rear direction, arranged are protrusive portions 31B. Each protrusive portion 31B has a cylindrical shape protruding upward from the upper edge of the sidewall 31. The protrusive portions 31B on each sidewall 31 are spaced apart from each other in the front-rear direction. On the upper edge of each sidewall 31, at an outer position with respect to each protrusive portion 31B, arranged is a protrusive portion 31C. Each protrusive portion 31C has a shape of a plate, which protrudes upward from the upper edge of the sidewall 31. One of the protrusive portions 31C on the sidewall 31 on the left extends longitudinally from a frontward end position to a rearward end position on the upper edge of the sidewall 31. The sidewall 31 on the right has two (2) protrusive portions 31, which are arranged on the upper edge at a frontward position with respect to one of the protrusive portions 31B and at a rearward position with respect to the other of the protrusive portions 31B.

On an inner face of each sidewall 31, at a frontward position with respect to the center of the sidewall 31 in the front-rear direction, formed is a guide 31D being a groove. The guide 31D is formed to curve in an arc. The guide 31D extends downward from a position between the protrusive portions 31B, which are arranged on the upper edge of the sidewall 31, curving to extend frontward. Each guide 31D is formed to be widened at an upper part thereof in proximity to the upper edge of the sidewall 31 to be wider at a higher position. The guides 31D are engageable with the protrusive portions 51B of the head holder 5 (see FIG. 4), as will be described further below.

Each sidewall 31 has an extended portion 31E, which extends upward from the upper edge of the sidewall 31 at a rearward position with respect to the protrusive portion 31C. At a tip end of each extended portion 31E, arranged is a protrusive portion 311 in a cylindrical shape protruding inward in the widthwise direction. The protrusive portion 311 may pivotably support a subsidiary arm 6, which will be described further below.

<Cartridge Case 4 and Ink Ribbon R>

As shown in FIG. 3, the cartridge case 4 is attachable to the ink ribbon supporting member 3 from an upper side to be used. In the following paragraphs, unless otherwise noted, directions related to the cartridge case 4 will be based on the posture of the cartridge case 4 being attached to the ink ribbon supporting member 3, which is stored in the second case 22 at the third position (closed position), as shown in FIG. 3 and as indicated by the arrows in FIG. 3.

As shown in FIG. 5, the cartridge case 4 has two (2) extended portions 41, bridged portions 42, 43, two (2) first sidewalls 44, and two (2) second sidewalls 45. The extended portions 41 extend in the front-rear direction and are spaced apart from each other in the widthwise direction. Each first sidewall 44 has a shape of a plate, of which lower end is rounded, and extends downward from a rearward position in each extended portion 41. Each first sidewall 44 has a recessed portion 44A, which is recessed downward from an upper end of the first sidewall 44. The bridged portion 42 has a shape of a plate and extends between rearward ends of the first sidewalls 44. In the following paragraphs, an area enclosed by the first sidewalls 44 and the bridged portion 42 will be expressed as a ribbon storage H1 (see FIG. 3). Each second sidewall 45 has a shape of a plate, of which lower end is rounded, and extends downward from a frontward position in each extended portion 41. Each second sidewall 45 has a recessed portion 45A, which is recessed downward from an upper end of the second sidewall 45. The bridged portion 43 has a shape of a plate and extends between frontward ends of the second sidewalls 45. In the following paragraphs, an area enclosed by the second sidewalls 45 and the bridged portion 43 will be expressed as a ribbon storage H2 (see FIG. 3). At a lower end of the cartridge case 4, and at a position between the bridged portion 42 and the bridged portion 43, formed is an opening 46 (see FIG. 3), of which outline forms a rectangle.

Each extended portion 41 has two (2) holes 41A in an intermediate area between areas, at which the first sidewall 44 is connected to the extended portion 41 and at which the second sidewall 45 is connected to the extended portion 41. Each hole 41A has a round outline. A distance between the holes 41A in each extended portion 41 is equal to a distance between the protrusive portions 31B arranged in the ink ribbon supporting member 3.

The ink ribbon R is attached to and rolled around a first spool R11 at one end and attached to and rolled around a second spool R21 at the other end. In the following paragraphs, a part of the ink ribbon R rolled around the first spool R11 will be expressed as a ribbon roll R1, and another part of the ink ribbon R rolled around the second spool R21 will be expressed as a ribbon roll R2.

The ribbon roll R1 may be stored in the cartridge case 4 as the first spool R11 is placed in the recessed portions 44A, 44A formed in the first walls 44 on the right and the left, respectively, from an upper side. The ribbon roll R2 may be stored in the cartridge case 4 as the second spool R21 is placed in the recessed portions 45A, 45A formed in the second walls 45 on the right and the left, respectively, from the upper side. The ribbon roll R1 is stored in the ribbon storage H1, and the ribbon roll R2 is stored in the ribbon storage H2. Axial centers of the first spool R11 and the second spool R21 extend in the widthwise direction and are apart from each other for a predetermined distance L in the front-rear direction. The first spool R11 is located at a rearward position with respect to the second spool R21. In other words, the first spool R11 is located on a side closer to the rear in the front-rear direction, and the second spool R21 is located on the other side farther from the rear in the front-rear direction, within the cartridge case 4. The first spool R11 and the second spool R 21 are rotatably supported by the cartridge case 4. The ink ribbon R extends between the ribbon roll R1 and the ribbon roll R2 to cross over the opening 46 (see FIG. 3) at the lower end of the cartridge case 4. The first spool R11 and the second spool R21 may rotate in a direction such that the ink ribbon R is unwound from the ribbon roll R1 and wound around the ribbon roll R2. Therefore, as the ink ribbon R is rolled from the ribbon roll R1 to the ribbon roll R2, the extended part of the ink ribbon R between the ribbon roll R1 and the ribbon roll R2 may move frontward. The moving direction for the ink ribbon R is the same as a moving direction for the printing medium, which is rolled out from the medium roll Q (see FIG. 2), as an image is being printed in the thermal-transfer printer 1A.

The cartridge case 4 is attachable to the ink ribbon supporting member 3 to be installed in a frontward area with respect to a center in the front-rear direction in the ink ribbon supporting member 3 from the upper side. In other words, the ink ribbon supporting member 3 may accept the cartridge case 4 with the ink ribbon R to be attached thereto from the upper side. When attached to the ink ribbon supporting member 3, lower ends of the extended portions 41 in the cartridge case 4 contact the upper ends of the sidewalls 31 in the ink ribbon supporting member 3, and the protrusive portions 31B on the ink ribbon supporting member 3 fit in the holes 41A in the cartridge case 4 (see FIG. 3). The extended portions 41 in the cartridge case 4 are flanked sideward by the protrusive portions 31C in the ink ribbon supporting member 3 from the outer sides in the widthwise direction.

<Subsidiary Arm 6>

The subsidiary arm 6 is pivotably supported by the ink ribbon supporting member 3. The subsidiary arm 6 may pivot about a fifth axis X15 (see FIG. 5) as the head holder 5 moves in response to a pivoting motion of the cover 23. FIG. 3 shows the subsidiary arm 6 when the cover 23 is at the second position (open position). FIG. 5 shows the subsidiary arm 6 when the cover 23 is at the first position (closed position). In the following paragraphs, unless otherwise noted, directions related to the subsidiary arm 6 will be based on the posture of the subsidiary arm 6 when the cover 23 is at the first position (closed position), as shown in FIG. 5 and as indicated by the arrows in FIG. 5.

As shown in FIG. 5, the subsidiary arm 6 has two (2) extended portions 61 and a bridged portion 62. The extended portions 61 extend in the front-rear direction. The extended portions 61 are spaced apart from each other in the widthwise direction. The extended portions 61 are bended at a central area in the front-rear direction so that a distance between the extended portions 61 in the widthwise direction at a frontward area is shorter than a distance between the extended portions in the widthwise direction at a rearward area. The bridged portion 62 has an approximate shape of a plate, which is extended between central areas in the extended portions 61 in the front-rear direction.

Each extended portion 61 has a second engageable portion 63 at the frontward area therein. The second engageable portion 63 is formed to have a recessed portion 63A, which is recessed upper-rearward from a lower-frontward end of the second engageable portion 63. The second engageable portion 63 is engageable with the conveyer roller 51D (see FIG. 4) in the head holder 5. At a rearward area in the extended portion 61, formed through in the widthwise direction is a hole 64. The protrusive portions 311 in the ink ribbon supporting member 3 are inserted in the holes 64 inward in the widthwise direction from the widthwise outer side. The subsidiary arm 6 is pivotably supported by the ink ribbon supporting member 3 to pivot about the fifth axis X15, which extends in the widthwise direction, at the rearward areas in the extended portions 61.

<Opening Motion of Cover 23>

With reference to FIGS. 6-8, described below will be behaviors of the movable items in the thermal-transfer printer 1A when the cover 23 moves from the first position (closed position) to the second position (open position). The following description will be based on a condition where the second case 22 is maintained at the third position (closed position), and the ribbon rolls R1, R2 are not stored in the cartridge case 4. The motions may occur when, for example, a user opens the cover 23 in order to store the ribbon rolls R1, R2 in the unoccupied cartridge case 4, which is attached to the ink ribbon supporting member 3.

FIG. 6 shows the cover 23 located at the first position (closed position). The linkage 233 extending downward from the cover 23 is located between the ribbon storages H1, H2 in the cartridge case 4. The protrusive portions 51B (see FIG. 4) in the head holder 5 are located at lower ends of the guides 31D in the ink ribbon supporting member 3. The second axis X12 being the pivot axis for the head holder 5 is located between the ribbon storages H1, H2. The head holder 5 extends downward through opening 46 at the lower end of the cartridge case 4 to be located at a lower position with respect to the ribbon storage H2. The heater surface of the thermal head 50 faces downward toward the platen roller P at an upper position with respect to the platen roller P. The fitting portions 51E in the head holder 5 are placed to fit in bearings (not shown), which are located at widthwise end areas in the platen roller P, from an upper side. Thus, a position of the thermal head 50 with respect to the platen roller P may be maintained. A direction of the head holder 5 extending from the second axis X12 toward the thermal head 50 inclines with respect to the vertical direction, in a view from the right, lower-frontward. In the following paragraphs, the position of the head holder 5 in this posture as shown in FIG. 6 will be expressed as a printable position.

The subsidiary arm 6 is placed to longitudinally extend along the upper ends of the extended portions 41 (see FIG. 5) of the cartridge case 4. The subsidiary arm 6 extends horizontally between the fifth axis X15, which is the pivot axis thereof, and the second engageable portions 63. In the following paragraphs, the position of the subsidiary arm 6 in this posture as shown in FIG. 6 will be expressed as a fifth position. When the subsidiary arm 6 is at the fifth position, the second engageable portions 63 are separated from the conveyer roller 51D. When the subsidiary arm 6 is at the fifth position, the subsidiary arm 6 staying on the upper ends of the extended portions 41 of the cartridge case 4 may be restricted from moving downward.

FIG. 7 shows a transitive posture of the cover 23 being in transition to pivot from the first position (closed position) toward the second position (open position). The fitting portions 51E in the head holder 5 are separated from the bearings of the platen roller P. The protrusive portions 51B (see FIG. 4) in the head holder 5 moved along the guides 31D in the ink ribbon supporting member 3 reach the upper end areas in the guides 31D. The linkage 233 moved upward is located to be higher than the ink ribbon supporting member 3, and the second axis X12 being the pivot axis for the head holder 5 is located to be higher than the second case 22. The head holder 5 moved upward is located to be higher than the opening 46 of the cartridge case 4. A tip end portion of the head holder 5 is located between the ribbon storages H1, H2 in the cartridge case 4. The thermal head 50 is located at a rearward position with respect to the base 51 of the head holder 5. A direction of the head holder 5 extending from the second axis X12 toward the thermal head 50 in the view from the right is a downward direction. The subsidiary arm 6 stays at the fifth position, in the same position as shown in FIG. 6. In conjunction with the motion of the head holder 5, the conveyer roller 51D in the head holder 5 contacts the second engageable portions 63 in the subsidiary arm 6. More specifically, the conveyer roller 51D in the head holder 5 engages with the second engageable portions 63 in the subsidiary arm 6. In this regard, contact between the conveyer roller 51D and the second engageable portions 63 includes engagement between the conveyer roller 51D and the second engageable portions 63. A minimum distance between the conveyer roller 51D and the cover 23, when the conveyer roller 51D in the head holder 5 contacts the second engageable portions 63 in the subsidiary arm 6 while the cover 23 is in transition to pivot from the first position to the second position, will be expressed as a first distance M11 (not shown).

As the cover 23 pivots further toward the second position (open position), the protrusive portions 51B (see FIG. 4) separate upward from the guides 31D in the ink ribbon supporting member 3. Meanwhile, the conveyer roller 51D in the head holder 5 and the second engageable portions 63 stay in contact with each other. More specifically, the engagement between the conveyer roller 51D in the head holder 5 and the second engageable portions 63 in the subsidiary arm 6 is maintained. In response to the pivoting motion of the cover 23, with the conveyer roller 51D being engaged with the second engageable portions 63, the subsidiary arm 6 pivots about the fifth axis X15. Moreover, when the subsidiary arm 6 extending from the fifth axis X15 toward the second engageable portions 63 is in a posture to incline rearward with respect to the vertical direction, the subsidiary arm 6 acts on the head holder 5 to apply a rearward force so that the thermal head 50 is pulled to be closer to the cover 23.

FIG. 8 shows the cover 23 moved to the second position (open position). The head holder 5 is located to be higher than the second case 22. The subsidiary arm 6 extending from the fifth axis X15 toward the second engageable portions 63 inclines upper-rearward with respect to the vertical direction. In the following paragraphs, the position of the subsidiary arm 6 in this posture as shown in FIG. 8 will be expressed as a sixth position. A direction of the head holder 5 extending from the second axis X12 toward the thermal head 50 inclines lower-frontward to a small extent with respect to the vertical direction in the view from the right. The heater surface of the thermal head 50 faces toward the cover 23. In the following paragraphs, the position of the head holder 5 in this posture shown in FIG. 8 will be expressed as a retracted position. A minimum distance between the cover 23 and the conveyer roller 51D while the head holder 5 is at the retracted position will be expressed as a second distance M12 (not shown). The second distance M12 is shorter than the first distance M11, which is the minimum distance between the conveyer roller 51D and the cover 23 when the conveyer roller 51D in the head holder 5 contacts the second engageable portions 63 in the subsidiary arm 6 while the cover 23 is in transition to pivot from the first position to the second position (see FIG. 7).

Meanwhile, a distance between the fifth axis X15 and the second engageable portions 63 in the subsidiary arm 6, and a distance between the fifth axis X15 and the second axis X12, while the subsidiary arm 6 is located at the sixth position, will be expressed as a third distance M23 and a fourth distance M24, respectively. The third distance M23 is shorter than the fourth distance M24.

The head holder 5 is located rearward with respect to a rearward end of the cartridge case 4. In particular, the head holder 5 is located to be closer to the first axis X11, which is the pivot axis for the cover 23, than an end of the cartridge case 4 closer to the first axis X11 in the front-rear direction, i.e., the rearward end. In other words, the head holder 5 is located between the first axis X11 and the rearward end of the cartridge case 4 in the front-rear direction. Therefore, when, for example, the user attempts to remove the cartridge case 4 from the ink ribbon supporting member 3 in order to store the ribbon rolls R1, R2 in the cartridge case 4 and moves the cartridge case 4 upward, the cartridge case 4 may not collide with the head holder 5. Moreover, while the heater surface of the thermal head 50 faces rearward toward the cover 23, an undesirable touch by the user to the thermal head 50 may be prevented when the user attempts to move the cartridge case 4 upward.

<Closing Motion of Cover 23>

With reference to FIGS. 9-12, described below will be behaviors of the movable items in the thermal-transfer printer 1A when the cover 23 moves from second position (open position) to the first position (closed position). The following description will be based on a condition where the second case 22 is maintained at the third position (closed position). The motions may occur, for example, once the cartridge case 4 with the ribbon rolls R1, R2 stored therein is attached to the ink ribbon supporting member 3, and when the user attempts to close the cover 23 in order to start printing an image in the thermal-transfer printer 1A. The user may draw the printing medium from the medium roll Q stored in the first case 21 and place the printing medium on the platen roller P before closing the cover 23.

FIG. 9 shows the cover 23 being at the second position (open position). The subsidiary arm 6 is located at the sixth position, where the second engageable portions 63 is engaged with the conveyer roller 51D in the head holder 5 being at the retracted position.

FIG. 10 shows a transient posture of the cover 23 being in transition to pivot from the second position (open position) (see FIG. 9) to the first position (closed position) (see FIG. 12). With the conveyer roller 51D being engaged with the second engageable portions 63, the cover 23 pivots, and in response to the pivoting motion of the cover 23, the subsidiary arm 6 pivots about the fifth axis X15. When the subsidiary arm 6 extending from the fifth axis X15 toward the second engageable portions 63 is in a posture to incline frontward with respect to the vertical direction, the subsidiary arm 6 acts on the head holder 5 to apply a frontward force so that the thermal head 50 is pushed to be farther from the cover 23. The protrusive portions 51B (see FIG. 4) in the head holder 5 are directed toward the upper end areas in the guides 31D in the ink ribbon supporting member 3.

FIG. 11 shows another transient posture of the cover 23 further pivoting from the position shown in FIG. 10 toward the first position (closed position) (see FIG. 12). The subsidiary arm 6 is located at the fifth position, at which the conveyer roller 51D is separated from the second engageable portions 63. The protrusive portions 51B (see FIG. 4) in the head holder 5 enter the guides 31D in the ink ribbon supporting member 3. The head holder 5 enters the intermediate area between the ribbon rolls R1, R2 stored in the cartridge case 4 and moves downward. While the head holder 5 extends downward from the second axis X 12 toward the thermal head 50, the conveyer roller 51C in the head holder 5 contacts the ink ribbon R, which is extended between the ribbon rolls R1, R2, from the upper side. The head holder 5 passing through the intermediate area between ribbon rolls R1, R2 moves downward. While moving downward through the intermediate area between the ribbon rolls R1, R2, the head holder 5 does not contact the ribbon rolls R1, R2.

FIG. 12 shows the cover 23 being at the first position (closed position). The protrusive portions 51B (see FIG. 4) in the head holder 5 moved along the guides 31D in the ink ribbon supporting member 3 reach the lower ends in the guides 31D. The head holder 5 is located at the printable position. The heater surface of the thermal head 50 faces downward toward the platen roller P (see FIG. 2) at the upper position with respect to the platen roller P. In this arrangement, the ink ribbon R and the printing medium are interposed between the thermal head 50 and the platen roller P from the upper side and the lower side, respectively. The fitting portions 51E in the head holder 5 are placed to fit in the bearings, which are located at widthwise end areas in the platen roller P, from the upper side. Thus, the position of the thermal head 50 with respect to the platen roller P may be maintained.

In this arrangement, the printing medium and the ink ribbon R at the position between the platen roller P and the thermal head 50 may be conveyed frontward. The conveyer rollers 51C, 51D in the head holder 5 may rotate along with the conveyance of the ink ribbon R. As the thermal head 50 is heated, the ink on the ink ribbon R may be transferred onto the printing medium. Thus, an image may be printed on the printing medium.

<Arrangement of First Axis X11 and Second Axis X12>

With reference to FIG. 13, described below will be arrangement of the first axis X11 and the second axis X12 when the head holder 5 is located at the printable position. The following description will be based on a condition where the second case 22 is located at the third position (closed position), and the cover 23 is located at the first position (closed position).

In a condition where the cartridge case 4 with the ribbon rolls R1, R2 being stored therein is attached to the ink ribbon supporting member 3, a position where the axial center of the first spool R11 is located will be expressed as a first center C11, and a position where the axial center of the second spool R21 is located will be expressed as a second center C12. The first center C11 and the second center C12 extend linearly in the widthwise direction. The first center C11 and the second center C12 are apart from each other for the predetermined distance L in the front-rear direction. A maximum radius Rm for the ribbon roll R1 and for the ribbon roll R2 corresponds to a length between the first center C11 and the lower end of the cartridge case 4 and a length between the second center C 12 and the lower end of the cartridge case 4, respectively. The maximum radius Rm is smaller than a half distance L/2, which is the predetermined distance L divided equally by 2.

A virtual plane containing the first center C11 and the second center C12 will be expressed as a plane S11. The plane S11 spreads horizontally to extend linearly in the front-rear direction in a view from the right or the left, i.e., in a view along the widthwise direction. A virtual plane, which is located to be lower than the plane S11 and apart from the plane S11 for the half distance L/2, will be expressed as a plane S12. The plane S12 is located to be lower than the lower end of the cartridge case 4. The plane S12 is located to be higher than an axial center P1 of the platen roller P and higher than an axial center Q1 of the medium roll Q, around which the printing medium is rolled. Another virtual plane, which is located to be higher than the plane S11 and apart from the plane S11 for the half distance L/2, will be expressed as a plane S13. The plane S13 is located to be substantially lower than an upper end of the second case 22. The position of the plane S12 will be expressed as a lower-end position Sp12, and the position of the plane S13 will be expressed as an upper-end position Sp13.

The first axis X11 is located within a first area T1. The first area T1 is located frontward, i.e., closer to the front side of the thermal-transfer printer 1A, with respect to the wall 22D at the rear end of the second case 22; rearward, i.e., closer to the rear side of the thermal-transfer printer 1A, with respect to the first center C11; lower than the wall 22E being the upper wall of the second case 22, more specifically, lower than the upper-end position Sp13; and higher than the lower-end position Sp12. With regard to FIG. 13, the first axis X11 is located within the first area T1, in proximity to a downward face of the wall 22E of the second case 22. More specifically, the first axis X 11 is located within the first area T1, at a position higher than a center between the wall 22E of the second case 22 and the plane S11, and lower than the wall 22E.

The second axis X12 is located within a second area T2. The second T2 is located frontward, i.e., closer to the front side of the thermal-transfer printer 1A, with respect to the first center C11; rearward, i.e., closer to the rear side of the thermal-transfer printer 1A, with respect to the second center C12; lower than the wall 22E of the second case 22, more specifically, lower than the upper-end position Sp13; and higher than the lower-end position Sp12. Meanwhile, the second area T2 between the first center C11 and the second center C12 is trisected in the front-rear direction equally into three (3) divided areas T21, T22, T23 by virtual planes spreading, for example, orthogonally to the front-rear direction. The divided areas T21, T22, T23 are arranged at a frontward position, a central position, and at a rearward position, respectively, in the order given in the second area T2 along the front-rear direction. With regard to FIG. 13, the second axis X12 is located in the divided area T22 in midst between the divided area T21 and the divided area T23 in the front-rear direction.

Second Embodiment

A thermal-transfer printer 1B according to a second embodiment of the present disclosure will be described in the following paragraphs. In the following description, items or structures which are identical or equivalent to those described in the previous embodiment may be referred to by the same reference signs, and explanation of those will be omitted.

<Case 2B>

As shown in FIG. 14, the thermal-transfer printer 1B includes a case 2B, which has an approximate shape of a rectangular box. The case 2B includes a second case 24 in place of the second case 22 in the thermal-transfer printer 1A (see FIG. 1). The second case 24 is pivotably supported by the linkages 213 (see FIG. 2) on the first case 21 to pivot about a third axis X23, which extends in the widthwise direction. The second case 24 may pivot to open and close the opening 211 (see FIG. 2) of the first case 21. The second case 24 may be located the same positions as the second case 22, including the third position (closed position) and the fourth position (open position), and the directions related to the second case 24 will be based on those of the second case 24 being at the third position (closed position) as shown in FIG. 14 and as indicated by the arrows in FIG. 14.

The second case 24 includes walls 24A, 24B, 24C, 24D, 24E, which serve as parts of a front wall, a right-side wall, a left-side wall, a rear wall, and an upper wall, respectively, of the second case 24. Lower ends of the walls 24A-24D form an opening 241 at a lower end of the second case 24. Unlike the second case 22 in the first embodiment, no recess is formed in the wall 24A or 24E, in other words, the second case 24 does not have an opening at an upper position therein. On a frontward face of the wall 24A, arranged is a handle 242 protruding frontward.

When the second case 24 is at the third position (closed position) to cover the opening 211 of the first case 21, the opening 211 at the upper end of the first case 21 and the opening 241 at the lower end of the second case 24 are connected to be at least partly continuous with each other.

When the second case 24 is at the third position (closed position), a frontward face of the wall 21A, the rightward face of the wall 21B, the leftward face of the wall 21C, the rearward face of the wall 21D align flat on same vertical planes with a frontward of the wall 24A, a rightward face of the wall 24B, a leftward face of the wall 24C, and a rearward face of the wall 24D, respectively without forming different-leveled tiers so that at joints between the walls 21A and 24A, between the walls 21B and 24B, between the walls 21C and 24C, and between the walls 21D and 24D, no substantial difference in depth or width is caused.

An ink ribbon supporting member 7 (see FIG. 15), in place of the ink ribbon supporting member 3 (see FIG. 5) in the first embodiment, is pivotably supported by the linkages 213 (see FIG. 1) on the first case 21. The cartridge case 4, as described in the first embodiment, is attachable to the ink ribbon supporting member 7. The second case 24 may store the ink ribbon supporting member 7 and the cartridge case 4 therein.

<Ink Ribbon Supporting Member 7>

As shown in FIG. 15, to the ink ribbon supporting member 7, the cartridge case 4 supporting the ribbon rolls R1, R2 (see FIG. 5) therein is attachable from the upper side. FIG. 15 shows appearance of the ink ribbon supporting member 7 when the ink ribbon supporting member 7 is stored in the second case 24. The ink ribbon supporting member 7 is attached to an interior of the second case 24. In the following paragraphs, unless otherwise noted, directions related to the ink ribbon supporting member 7 will be based the on those of the ink ribbon supporting member 7 and as indicated by the arrows in FIG. 15. A part of the ink ribbon supporting member 7 in a rearward area is located to be higher than the medium storage 212 (see FIG. 2) in the first case 21.

As shown in FIG. 16, the ink ribbon supporting member 7 has two (2) sidewalls 71 and a bridged portion 72. The sidewalls 71 correspond to the sidewalls 31 (see FIG. 5) in the ink ribbon supporting member 3 in the first embodiment. A distance between the sidewalls 71 is substantially equal to a distance between the walls 24B, 24C of the second case 24 (see FIG. 14). The sidewalls 71 on the right and the left are located in proximity to inner surfaces of the wall 24B and the wall 24C, respectively. The bridged portion 72 corresponds to the bridged portion 32 (see FIG. 5).

Each sidewall 71 has an extended portion 71A, which extends rearward at a rearward area in the sidewall 71. An end of the extended portion 71A is connectable to the linkage 213 (see FIG. 2) in the first case 21 pivotably to pivot about a fourth axis X24, which extends in the widthwise direction. A position of the fourth axis X24 is different from a position of a third axis X23 (see FIG. 14), which is a pivot axis for the second case 24 pivotably supported by the linkages 213. Protrusive portions 71B and protrusive portions 71C on the upper edges of the sidewalls 71 correspond to the protrusive portions 31B and the protrusive portions 31C (see FIG. 5) on the ink ribbon supporting member 3 in the first embodiment. When the cartridge case 4 is attached to the ink ribbon supporting member 7 from the upper side, the protrusive portions 71B on the ink ribbon supporting member 7 fit in the holes 41A in the cartridge case 4 (see FIG. 3). The extended portions 41 in the cartridge case 4 are flanked sideward by the protrusive portions 71C in the ink ribbon supporting member 7 from the outer sides in the widthwise direction.

Guides 71D arranged on inner faces of the sidewalls 71 correspond to the guides 31D (see FIG. 5) in the ink ribbon supporting member 3 in the first embodiment. Each guide 71D is engageable with one of the protrusive portions 51B in the head holder 5, as will be described further below.

Each sidewall 71 has protrusive portions 711, 712, which protrude inward from an inner face of the sidewall 71, at rearward positions with respect to a center of the ink ribbon supporting member 7 in the front-rear direction. The protrusive portions 711, 712 each has a cylindrical shape. The protrusive portions 711, 712 align in the vertical direction, and the protrusive portion 711 is located to be lower than the protrusive portion 712. The protrusive portions 711 may pivotably support a subsidiary arm 8, as will be described further below. The protrusive portions 712 may pivotably support a head arm 9, as will be described further below.

<Head Arm 9>

As shown in FIG. 16, the head arm 9 includes two (2) bases 91, a bridged portion 92, and a linkage 93. The bases 91 each has an approximate shape of a bar and are located to be spaced apart from each other in the widthwise direction. A distance between the bases 91 is substantially equal to a distance between the sidewalls 71 in the ink ribbon supporting member 7. The bridged portion 92 has an approximate shape of a plate and is extended between frontward portions of the bases 91.

The head arm 9 is pivotably supported by the protrusive portions 712 in the ink ribbon supporting member 7. FIGS. 15 and 16 show the head arm 9 at a farthest counterclockwise-pivoted position for the head arm 9 in a view from the right. In this position shown in FIGS. 15 and 16, the bases 91 in the head arm 9 extend horizontally. In the following paragraphs, unless otherwise noted, directions related to the head arm 9 will be based on the posture of the head arm 9 at the farthest counterclockwise-pivoted position as shown in FIGS. 15, 16 and as indicated by the arrows in FIGS. 15 and 16. Meanwhile, pivotable directions, e.g., clockwise and counterclockwise, concerning each item in the following description will be based on a sideward view from the right.

Each of the bases 91 has a hole 911 in a form of a slit on an upper end position therein. The hole 911 is formed to longitudinally extend in the front-rear direction. Each base 91 has extended portions 94, 95 at a rearward end position therein. The extended portion 94 extends lower-rearward at the rearward area in the base 91. At a rearward end in the extended portion 94, formed through in the widthwise direction is a hole 941. The extended portion 95 extends rearward at a rearward area in the extended portion 94. On an outer face of each extended portion 94, arranged is a protrusive portion 951 protruding outward in the widthwise direction.

The protrusive portions 712 on the ink ribbon supporting member 7 are inserted in the holes 941 in the head arm 9 inward in the widthwise direction from the widthwise outer side.

The head arm 9 is pivotably supported by the ink ribbon supporting member 7 to pivot about a first axis X21, which extends through the holes 941 and the protrusive portions 712 in the widthwise direction. In the following paragraphs, the position of the head arm 9 at the farthest counterclockwise-pivoted position pivoted about the first axis X21, as shown in FIGS. 15 and 17, will be expressed as a first position. As shown in FIGS. 15 and 17, when the head arm 9 is located at the first position, the bases 91 contact the extended portions 41 in the cartridge case 4 attached to the ink ribbon supporting member 7 from the upper side. Meanwhile, as shown in FIG. 15, the bridged portion 92 covers a rearward area with respect to a center in the front-rear direction in the cartridge case 4 from the upper side. In this regard, when the cartridge case 4 holds the ribbon rolls R1, R2 therein, an upper side of the ribbon roll R1 may be covered by the bridged portion 92. The head arm 9 at the first position may be closer to the first case 21 (see FIG. 14) than the head arm 9 being in the other positions.

The head arm 9 is pivotable clockwise from the first position to pivot about the first axis X21, as shown in FIGS. 18-20. FIG. 20 shows the head arm 9 at a farthest clockwise-pivoted position pivoted clockwise about the first axis X21. In the following paragraphs, the position of the head arm 9 at the farthest clockwise-pivoted position pivoted about the first axis X21, as shown in FIG. 20, will be expressed as a second position. The second position for the head arm 9 is higher than the first position. When the head arm 9 is located at the second position, the bases 91 extend upper-rearward. The head arm 9 in the second position is separated farther from the first case 21 than the head arm 9 in the first position.

As shown in FIG. 16, on a lower face of the bridged portion 92, arranged is a linkage 93. The linkage 93 includes two (2) side plates 93A and a bridged portion 93B. The side plates 93A are spaced apart from each other in the widthwise direction and spread orthogonally to the widthwise direction. At a lower end of each side plate 93A, bored through in the widthwise direction is a hole 932. The bridged portion 93B having an approximate shape of a plate is extended between the side plates 93A. On a frontward face of the bridged portion 93B, arranged is a knob 931. The knob 931 has an approximate shape of a plate extended frontward. A user may hold the knob 931 by hand in order to pivot the head arm 9 clockwise or counterclockwise with respect to the ink ribbon supporting member 7.

The head holder 5, which may be identical with the head holder 5 described in the first embodiment, is attached to a tip end of the linkage 93. The protrusive portions 51A on the sidewalls 511 in the head holder 5 are inserted outward in the widthwise direction into the holes 932 formed in the side plates 93A in the linkage 93. The head holder 5 is pivotably supported by the head arm 9 to pivot about a second axis X22, which extends through the holes 932 in the side plates 93A in the widthwise direction.

<Subsidiary Arm 8>

The subsidiary arm 8 is pivotably held by the ink ribbon supporting member 7. The subsidiary arm 8 may pivot in response to a pivoting motion of the head arm 9. FIG. 16 shows the subsidiary arm 8 when the head arm 9 is located at the first position. In the following paragraphs, unless otherwise noted, directions related to the subsidiary arm 8 will be based on a posture of the subsidiary arm 8 when the head arm 9 is at the first position, as shown in FIG. 16 and as indicated by the arrows in FIG. 16.

As shown in FIG. 16, the subsidiary arm 8 has two (2) extended portions 81 and a bridged portion 82. Each extended portion 81 has a first portion 81A, a second portion 81B, and a third portion 81C. The first portion 81A extends horizontally in the front-rear direction. The second portion 81B extends downward from a rearward end of the first portion 81A. The third portion 81C extends lower-rearward from a rearward end of the second portion 81B. The bridged portion 82 has an approximate shape of a plate and extends between the first portions 81A in the extended portions 81.

Each first portion 81A in the extended portion 81 has a second engageable portion 83, which has an approximate shape of a plate, having a recessed portion 83A. The recessed portion 83A is formed to recess rearward from a frontward end of the second engageable portion 83. The second engageable portions 83 are engageable with the conveyer roller 51D (see FIG. 4) in the head holder 5. In the third portion 81C in each extended portion 81, formed through in the widthwise direction is a hole 84. The protrusive portions 711 in the ink ribbon supporting member 7 are inserted inward in the widthwise direction in the holes 84 from the widthwise outer side. The subsidiary arm 8 is pivotably supported by the ink ribbon supporting member 7 to pivot about a fifth axis X25, which extends in the widthwise direction, at the rearward areas in the extended portions 81. At a rearward end positions in each third portion 81C in the extended portion 81, arranged is a third engageable portion 85, in which a recessed portion 85A is formed. The third engageable portion 85 is engageable with the protrusive portion 951 in the head arm 9.

<Opening and Closing Motions of Head Arm 9>

With reference to FIGS. 17-20, described below will be behaviors of the movable items in the thermal-transfer printer 1B when the head arm 9 moves between the first position (see FIG. 17) and the second position (see FIG. 20). The following description will be based on a condition where the second case 24 is maintained at the third position (closed position), and the ribbon rolls R1, R2 are not stored in the cartridge case 4. The motions may occur when, for example, when the user moves the second case 24 (see FIG. 14) to the fourth position (open position) to operate the head arm 9 in order to take out the cartridge case 4 and store the ribbon rolls R1, R2 in the cartridge case 4, and the user operates the knob 931 on the head arm 9 to move the head arm 9 from the first position to the second position.

FIG. 17 shows the head arm 9 located at the first position. The linkage 93 extending downward in the head arm 9 is located between the ribbon storages H1, H2 in the cartridge case 4. The protrusive portions 51B (see FIG. 16) in the head holder 5 are located at lower ends of the guides 71D in the ink ribbon supporting member 7. The head holder 5 is located at the printable position. The second axis X22 being the pivot axis for the head holder 5 is located between the ribbon storages H1, H2. A direction of the head holder 5 extending from the second axis X22 toward the thermal head 50 inclines with respect to the vertical direction, in the view from the right, lower-frontward.

The first portions 81A in the subsidiary arm 8 contact the upper ends of the extended portions 41 in the cartridge case 4 and extend in the horizontal direction. The subsidiary arm 8 is restricted from pivoting counterclockwise by the cartridge case 4 contacting the first portions 81A. In other words, the cartridge case 4 may restrict the subsidiary arm 8 at the fifth position from pivoting in a direction opposite to the second direction, i.e., counterclockwise, by the contact with the first portions 81A. A part of each second engageable portion 83 in the subsidiary arm 8 enters the hole 911 in the head arm 9 from the lower side to protrude to be partly higher than the base 91 in the head arm 9. In the following paragraphs, unless otherwise noted, the position of the subsidiary arm 8 in this posture will be expressed as a fifth position, which corresponds to a condition of the subsidiary arm 8 at the farthest counterclockwise-pivoted position. When the subsidiary arm 8 is at the fifth position, the second engageable portions 83 are separated from the conveyer roller 51D.

FIG. 18 shows a transient posture of the head arm 9 being in transition to pivot from the first position toward the second position. The protrusive portions 51B (see FIG. 16) in the head holder 5 moved along the guides 71D in the ink ribbon supporting member 7 reach the upper end areas in the guides 71D. The linkage 93 in the head arm 9 moved upward is located to be higher than the ink ribbon supporting member 7, and the second axis X22 being the pivot axis for the head holder 5 is located to be higher than the ink ribbon supporting member 7. The head holder 5 moved upward is located to be higher than the opening 46 (see FIG. 3) of the cartridge case 4. The tip end portion of the head holder 5 is located between the ribbon storages H1, H2 in the cartridge case 4. The thermal head 50 is located at a rearward position with respect to the base 51 of the head holder 5. A direction of the head holder 5 extending from the second axis X22 toward the thermal head 50 in the view from the right is a downward direction. The subsidiary arm 8 stays at the fifth position, in the same position as shown in FIG. 17. In conjunction with the motion of the head holder 5, the conveyer roller 51D in the head holder 5 contacts the second engageable portions 83 in the subsidiary arm 8, and the protrusive portions 951 in the head arm 9 are engaged with the third engageable portions 85 from the rear side. A minimum distance between the conveyer roller 51D and the second engageable portions 83 in the subsidiary arm 8, when the conveyer roller 51D in the head holder 5 contacts the second engageable portions 83 in the subsidiary arm 8 while the head arm 9 is in transition to pivot from the first position to the second position, will be expressed as a first distance M21 (not shown).

FIG. 19 shows the head arm 9 pivoted further toward the second position from the position shown in FIG. 18. The protrusive portions 51B (see FIG. 16) separate upward from the guides 71D in the ink ribbon supporting member 7. Meanwhile, the engagement between the protrusive portions 951 in the head arm 9 and the third engageable portions 85 in the subsidiary arm 8 is maintained. In response to the pivoting motion of the head arm 9, with the protrusive portions 951 being engaged with the third engageable portions 85, the subsidiary arm 8 pivots about the fifth axis X25. Meanwhile, the contact between the conveyer roller 51D in the head holder 5 and the second engageable portions 83 in the subsidiary arm 8 is maintained.

As the head arm 9 pivots further toward the second position, the second engageable portions 83 in the subsidiary arm 8 are engaged with the conveyer roller 51D in the head holder 5. The subsidiary arm 8 may pivot to accompany with the pivoting motion of the head arm 9 and may act on the head holder 5 to apply a rearward force so that the thermal head 50 is pulled to be closer to the head arm 9.

FIG. 20 shows the head arm 9 moved to the second position. The head holder 5 is located to be higher than the second case 24. The first part 81A in the subsidiary arm 8 extends vertically. In the following paragraphs, the position of the subsidiary arm 8 in this posture as shown in FIG. 20 will be expressed as a sixth position. A direction of the head holder 5 extending from the second axis X22 toward the thermal head 50 inclines lower-frontward to a small extent with respect to the vertical direction. The head holder 5 is located at the retracted position, and the heater surface of the thermal head 50 faces toward the head arm 9. A minimum distance between the head arm 9 and the conveyer roller 51D while the head holder 5 is at the retracted position will be expressed as a second distance M22 (not shown). The second distance M22 is shorter than the first distance M21, which is the minimum distance between the conveyer roller 51D and the second engageable portions 83 when the conveyer roller 51D in the head holder 5 contacts the second engageable portions 83 in the subsidiary arm 8 as the head arm 9 pivots from the first position to the second position.

Meanwhile, a distance between the fifth axis X25 and the second engageable portions 83 in the subsidiary arm 8, and a distance between the fifth axis X25 and the second axis X22, while the subsidiary arm 8 is located at the sixth position, will be expressed as a third distance M23 (not shown) and a fourth distance M24 (not shown), respectively. The third distance M23 is shorter than the fourth distance M24.

The head holder 5 is located rearward with respect to a rearward end of the cartridge case 4. In particular, the head holder 5 is located to be closer to the first axis X21, which is the pivot axis for the head arm 9, than an end of the cartridge case 4 that is closer to the first axis X21, in the front-rear direction. In other words, the head holder 5 is located between the first axis X21 and the rearward end of the cartridge case 4. Therefore, when, for example, the user attempts to remove the cartridge case 4 from the ink ribbon supporting member 7 and moves the cartridge case 4 upward, the cartridge case 4 may not collide with the head holder 5. Moreover, while the heater surface of the thermal head 50 faces toward the head arm 9, an undesirable touch by the user to the thermal head 50 may be prevented when the user attempts to move the cartridge case 4 upward.

The head arm 9 may move from the second position (see FIG. 20) to the first position (see FIG. 17). For example, when the thermal-transfer printer 1B is in the condition shown in FIG. 20, the user may attach the cartridge case 4 with the ribbon rolls R1, R2 stored therein to the ink ribbon supporting member 7 and operate the knob 931 in the head arm 9 to move the head arm 9 from the second position to the first position before starting printing an image in the thermal-transfer printer 1A.

While the protrusive portions 951 are engaged with the third engageable portions 85 in the subsidiary arm 8, as shown in FIG. 19, the head arm 9 pivots from the second position toward the first position. Therefore, the subsidiary arm 8 subjected to the force from the head arm 9 through the third engageable portions 85 pivots about the fifth axis X25 from the sixth position (see FIG. 20) toward the fifth position (see FIG. 17). Meanwhile, the second engageable portions 83 in the subsidiary arm 8 are engaged with the conveyer roller 51D in the head holder 5. Therefore, the subsidiary arm 8 may act on the head holder 5 to apply a frontward force so that the thermal head 50 is pushed to be farther from the head arm 9. The protrusive portions 51B (see FIG. 16) in the head holder 5 are directed toward the upper end areas in the guides 71D in the ink ribbon supporting member 7.

As shown in FIG. 18, the subsidiary arm 8 is moved by the pivoting motion of the head arm 9 to the fifth position while the conveyer roller 51D is separated from the second engageable portions 83. The protrusive portions 51B (see FIG. 16) in the head holder 5 moved to be higher than the upper edges of the guides 71D in the ink ribbon supporting member 7 enter the guides 71D. The head holder 5 entering between the ribbon rolls R1, R2 stored in the cartridge case 4 moves downward. While the direction of the head holder 5 extending from the second axis X22 toward the thermal head 50 is a downward direction, the conveyer roller 51C in the head holder 5 contacts the ink ribbon R, which is extended between the ribbon rolls R1, R2, from the upper side. The head holder 5 passing through the area between ribbon rolls R1, R2 moves downward.

As shown in FIG. 17, when the head arm 9 moves to the first position, the protrusive portions 51B (see FIG. 16) in the head holder 5 move along the guides 71D in the ink ribbon supporting member 3 to reach the lower end areas in the guides 71D. The head holder 5 is located at the printable position. The heater surface of the thermal head 50 faces downward toward the platen roller P (see FIG. 2) at the position higher than the platen roller P. In this arrangement, the ink ribbon R and the printing medium are interposed between the thermal head 50 and the platen roller P from the upper side and the lower side, respectively. As the thermal head 50 is heated, the ink on the ink ribbon R may be transferred onto the printing medium. Thus, an image may be printed on the printing medium.

<Arrangement of the First Axis X11 and the Second Axis X12>

With reference to FIG. 21, described below will be arrangement of the first axis X21 and the second axis X22 when the head holder 5 is located at the printable position. The following description will be based on a condition where the second case 24 is located at the third position (closed position), and the head arm 9 is located at the first position. In a condition where the cartridge case 4 with the ribbon rolls R1, R2 stored therein is attached to the ink ribbon supporting member 7, a position where a center of the first spool R11 is located will be expressed as a first center C21, and a position where a center of the second spool R21 is located will be expressed as a second center C22. The first center C21 and the second center C22 extend linearly in parallel with the widthwise direction. The first center C11 and the second center C12 are apart from each other for a predetermined distance L in the front-rear direction.

A virtual plane containing the first center C21 and the second center C22 will be expressed as a plane S21. The plane S21 spreads horizontally and extends linearly in the front-rear direction in a view from the right or the left, i.e., in a view along the widthwise direction. A virtual plane, which is located to be lower than the plane S21 and apart from the plane S21 for a half distance L/2 being a half of the predetermined distance L, will be expressed as a plane S22. Another virtual plane, which is located to be higher than the plane S21 and apart from the plane S21 for the half distance L/2, will be expressed as a plane S23. The plane S23 is located to be slightly lower than an upper end of the second case 24. The position of the plane S22 will be expressed as a lower-end position Sp22, and the position of the plane S23 will be expressed as an upper-end position Sp23.

The first axis X21 is located within a first area T3. The first area T3 is located frontward, i.e., closer to the front side of the thermal-transfer printer 1B, with respect to the wall 24D at the rear end of the second case 24; rearward, i.e., closer to the rear side of the thermal-transfer printer 1B, with respect to the first center C21; lower than the upper wall 24E of the second case 24, more specifically, lower than the upper-end position Sp23; and higher than the lower-end position Sp22. With regard to FIG. 21, the first axis X21 is located within the first area T3, in proximity to the plane S21. More specifically, the first axis X21 is located within the first area T3, at a position lower than a center between the plane S21 and the plane S23, and higher than a center between the plane S21 and the plane S22.

The second axis X22 is located within a second area T4. The second T4 is located frontward, i.e., closer to the front side of the thermal-transfer printer 1B, with respect to the first center C21; rearward, i.e., closer to the rear side of the thermal-transfer printer 1B, with respect to the second center C22; lower than the upper wall 24E of the second case 24, more specifically, lower than the upper-end position Sp23; and higher than the lower-end position Sp22. Meanwhile, the second area T4 between the first center C21 and the second center C22 in the front-rear direction is trisected equally into three (3) divided areas T41, T42, T43 by virtual planes spreading, for example, orthogonally to the front-rear direction. The divided areas T41, T42, T43 are arranged at a frontward position, a central position, and at a rearward position, respectively, in the order given in the second area T4 along the front-rear direction. With regard to FIG. 21, the second axis X22 is located in the divided area T42 in midst between the divided area T41 and the divided area T43 in the front-rear direction.

Third Embodiment

A thermal-transfer printer 1C according to a third embodiment of the present disclosure will be described in the following paragraphs. The thermal-transfer printer 1C includes a case 2C, which is in a different shape from the case 2A (see FIG. 1) in the thermal-transfer printer 1A in the first embodiment. The thermal-transfer printer 1C has the head holder 5, the ink ribbon supporting member 3, and the subsidiary arm 6, which are in the same configurations as those in the thermal-transfer printer 1A in the first embodiment. In the following description, items or structures which are identical or equivalent to those described in the previous embodiment may be referred to by the same reference signs, and explanation of those will be omitted.

<Case 2C>

As shown in FIG. 22, the thermal-transfer printer 1C includes the case 2C, which is in an approximate shape of a rectangular box. The case 2C includes a first case 26, a second case 27, and a cover 28, which partly form exterior faces of the thermal-transfer printer 1C. As shown in FIG. 23, the first case 26 includes walls 26A, 26B, 26C, 26D, 26E, and an opening 261, which correspond to the walls 21A, 21B, 21C, 21D, 21E, and the opening 211 in the case 2A (see FIG. 2) in the first embodiment. The first case 26 has a medium storage 262, in which the medium roll Q may be rotatably supported, inside. The case 2C is different from the case 2A (see FIG. 1) in forms of areas where the walls 26A-26E adjoin one another. In other words, corners in the first case 26 are rounded.

As shown in FIGS. 22 and 23, on the wall 23B in the case 2C, arranged is a lever 263, which is vertically movable. As shown in FIG. 23, in an area in proximity to each widthwise end of the wall 26A inside the case 2C, arranged is an engageable part 265 having a shape of a claw. The engageable part 265 may pivot so that an upper end thereof moves rearward in response to an operation to move the lever 263 downward. The engageable part 265 is engageable with an engagement portion (not shown) arranged on the second case 27.

The second case 27 is located at a position higher than the first case 26. The second case 27 is pivotably supported by the first case 26 at a rearward end portion thereof to pivot about a third axis X33, which extends in the widthwise direction. When the second case 27 is at a third position (closed position) (see FIG. 23), the second case 27 covers the opening 261 of the first case 26 from the upper side, and when the second case 27 is at a fourth position (open position) (see FIG. 22), the second case 27 uncovers the opening 261 of the first case 26. In the following paragraphs, unless otherwise noted, directions related to the second case 27 will be based on the posture of the second case 27 being at the third position (closed position), as shown in FIG. 22 and as indicated by the arrows in FIG. 22.

As shown in FIG. 22, the second case 27 includes walls 27A, 27B, 27C, 27D, 27E, which serve as parts of a front wall, a right-side wall, a left-side wall, a rear wall, and an upper wall, respectively, of the second case 27. The wall 27E is connected with upper ends of the walls 27B, 27C, at rearward portions with respect to the front-rear direction, and with an upper end of the wall 27D. Areas where the walls 27A-27E adjoin one another, in other words, corners in the second case 27, are rounded. Lower ends of the walls 27A-27D form an opening 271 (see FIG. 23) at a lower end of the second case 27. As shown in FIG. 24, an upper end of the wall 27A, a part of an upper end of the wall 27B, a part of an upper end of the wall 27C, and a frontward end of the wall 27E form an opening 272 of the second case 27. The opening 272 is located at an upper position while the second case 27 is at the third position (closed position). When the second case 27 is at the third position (closed position) to cover the opening 211 of the first case 21, the opening 211 at the upper end of the first case 21 and the opening 271 at the lower end of the second case 27 are connected to be at least partly continuous with each other.

Inside the case 2C, in proximity to each widthwise end of the wall 27A, arranged is the engagement portion (not shown), which is engageable with the engageable portion 265 (see FIG. 23) in the second case 27. With the engagement portions being engaged with the engageable portions 265, the second case 27 is maintained at the third position (closed position) and restrained from pivoting toward the fourth position (open position) (see FIG. 23). When the lever 263 on the first case 26 is moved downward, the engageable parts 265 may be released from the engagement portions so that the second case 27 may pivot from the third position (closed position) toward the fourth position (open position). Therefore, the user may move the lever 263 so that the second case 27 may move to the fourth position (open position) and expose the opening 261, and the user may set the medium roll Q in the medium storage 262 inside the first case 26.

As shown in FIGS. 22 and 24, a recess formed on an upper end of the wall 27A in the first case 26 and a recess formed on a lower end of the wall 27A in the second wall 27 together form an ejector opening 266. The printing medium, on which an image is printed in the thermal-transfer printer 1C, may be ejected outward through the ejector opening 266.

As shown in FIGS. 22 and 24, the cover 28 may open or close the opening 272 (see FIG. 24) of the second case 27. The cover 28 has a shape identical with the outline of the opening 272 and is curved downward at a frontend portion and widthwise portions. The cover 28 is movably supported by the second case 27 to pivot with respect to the second case 27 about a first axis X31, which extends in the widthwise direction through a rearward area with respect to the opening 272. The first axis X31 is located at a frontward position with respect to a third axis X33, which is the pivot axis for the second case 27. The position of the cover 28 covering the opening 272 (see FIG. 22) corresponds to the first position (closed position), and the position of the cover 28 uncovering the opening 272 corresponds to a second position (opening). The first axis X31 extends the rearward end area of the cover 28 being at the first position (closed position). In the following paragraphs, unless otherwise noted, directions related to the cover 28 will be based on the posture of the cover 28 being at the first position (closed position) while the second case 27 is at the third position (closed position), as shown in FIG. 22 and as indicated by the arrows in FIG. 22.

As shown in FIG. 22, the cover 28 has a locking part 281 at a frontward end area thereof. The locking part 281 is pivotably supported by the cover 28 at a rearward end portion thereof. The locking part 281 may, while the cover 28 is located at the first position (closed position), pivot counterclockwise to be engaged with the upper end portion of the wall 27A in the second case 27. Thereby, the cover 28 may be maintained at the first position (closed position) and restrained from pivoting toward the second position (open position). The locking part 281 may pivot clockwise to be disengaged from the wall 27A. While the cover 28 is at the second position (open position), the cartridge case 4 may be exposed through the opening 272. Therefore, for example, the user may move the locking part 281 to pivot clockwise to move the cover 28 from the first position (closed position) to the second position (open position) so that the user may remove the cartridge case 4 from the ink ribbon supporting member 3.

As shown in FIG. 24, on a lower face, i.e., an inner face, of the cover 28, arranged is a linkage 283, which protrudes downward from the lower face of the cover 28. The head holder 5 is pivotably supported by a tip end of the linkage 283. A second axis X32 being a pivot axis for the head holder 5 corresponds to the second axis X12 (see FIG. 3) in the first embodiment described above. As shown in FIG. 25, the second case 27 may store the ink ribbon supporting member 3 and the cartridge case 4 being attached to the ink ribbon supporting member 3 therein. Unlike the first embodiment, the ink ribbon supporting member 3 in the third embodiment is supported by extended portions 31A, which extend from the sidewalls 31, pivotably with respect to the second case 27. A fourth axis X34 being a pivot axis for the ink ribbon supporting member 3 and a fifth axis X35 being a pivot axis for the subsidiary arm 6 correspond to the fourth axis X14 and the fifth axis X15 (see FIG. 5), respectively, in the first embodiment.

Fourth Embodiment

A thermal-transfer printer 1D according to a fourth embodiment of the present disclosure will be described in the following paragraphs. The thermal-transfer printer 1D includes a case 2D, which is in a different shape from the case 2A (see FIG. 1) in the thermal-transfer printer 1A in the first embodiment. The thermal-transfer printer 1D has the head holder 5, the ink ribbon supporting member 3, and the subsidiary arm 6, which are in the same configurations as those in the thermal-transfer printer 1A in the first embodiment. In the following description, items or structures which are identical or equivalent to those described in the previous embodiment may be referred to by the same reference signs, and explanation of those will be omitted.

<Case 2D>

As shown in FIG. 26, the thermal-transfer printer 1D includes the case 2D, which has an approximate shape of a rectangular box. The case 2D includes the first case 21, a second case 29A, and a cover 29B. The first case 21 has outer faces that form approximately lower halves of a frontward face, a rightward face, a leftward face, and a rearward face; and a bottom face of the thermal-transfer printer 1D. The second case 29A has outer faces that form approximately upper halves of the frontward face, the rightward face, the leftward face, and the rearward face; and a part of an upper face of the thermal-transfer printer 1D. An outer face of the cover 29B forms another part of the upper face of the thermal-transfer printer 1D. Thus, the first case 21, the second case 29A, and the cover 29B form exterior faces of the thermal-transfer printer 1D.

As shown in FIG. 26, the second case 29A is located at an upper position with respect to the first case 21. The second case 29A is pivotably supported by the first case 21 to pivot about a third axis X43, which extends in the widthwise direction. The second case 29A may pivot to open or close the opening 211 (see FIG. 27) of the first case 21. FIG. 26 shows the second case 29A covering the opening 211 of the first case 21. In the following paragraphs, the position of the second case 29A covering the opening 211 as shown in FIG. 26 may be expressed as a third position (closed position), and unless otherwise noted, directions related to the second case 29A will be based on the posture of the second case 29A being at the third position (closed position), as shown in FIG. 26 and as indicated by the arrows in FIG. 26.

The second case 29A includes walls 29AA, 29AB, 29AC, 29AD, 29AE, which serve as parts of a frontward wall, a rightward wall, a leftward wall, a rearward wall, and an upper wall, respectively, of the second case 29A. Lower ends of the walls 29AA-29AD form an opening 291 (see FIG. 27) at a lower end of the second case 29A. As shown in FIG. 28, a recess 292A formed at an upper-end area in the wall 29AB and a cutout 292B formed in the widthwise direction at a frontward area in the wall 29AE form an opening 292 in the second case 29A. Meanwhile, the recess 292A, which is formed on the right-hand side in the second case 29A in the present embodiment, may not necessarily formed on the right-hand side but may be formed on the left-hand side. The opening 292 is located in an upper area in the second case 29A, when the second case 29A is at the third position (closed position). When the second case 29A is at the third position (closed position) to cover the opening 211 of the first case 21, the opening 211 at the upper end of the first case 21 and the opening 291 at the lower end of the second case 29A are connected to be at least partly continuous with each other.

As shown in FIG. 26, when the second case 29A is at the third position (closed position), the frontward surface of the wall 21A, the rightward surface of the wall 21B, the leftward surface of the wall 21C, the rearward surface of the wall 21D align flat on same vertical planes with a frontward surface of the wall 29AA, a rightward surface of the wall 29AB, a leftward surface of the wall 29AC, and a rearward surface of the wall 29AD, respectively, without forming different-leveled tiers. In other words, at joints between the wall 21A and the wall 29AA, between the wall 21B and the wall 29AB, between the wall 21C and the wall 29AC, and between the wall 21D and the wall 29AD, no substantial difference in depth or width is caused.

The second case 29A may store the ink ribbon supporting member 3, which will be described further below, and the cartridge case 4 attached to the ink ribbon supporting member 3 therein.

As shown in FIGS. 26-28, the cover 29B may open or close the opening 292 of the second case 29A. The cover 29B is pivotably supported by the second case 29A to pivot with respect to the second case 29A about a first axis X41, which extends in the widthwise direction through a rearward end area with respect to the opening 292. In the following paragraphs, unless otherwise noted, directions related to the cover 29B will be based on the posture of the cover 29B being at the first position (closed position) while the second case 29A is at the third position (closed position), as shown in FIG. 26 and as indicated by the arrows in FIG. 26.

As shown in FIG. 26, the cover 29B includes walls 29BA, 29BB. The wall 29BA has a shape substantially identical with an outline of the cutout 292B (see FIG. 28) in the second case 29A. The wall 29BA is pivotably supported by the second case 29A at a leftward end portion thereof. The wall 29BB has a shape substantially identical with an outline of the recess 292A (see FIG. 28) in the second case 29A. The wall 29BB extends, in a posture where the cover 29B is at the first position (closed position), downward from a rightward end of the wall 29BA in a direction orthogonal to the wall 29BA. In other words, a rightward portion of the cover 29B bends downward in the posture under the condition where the cover 29B is at the first position (closed position).

As shown in FIG. 28, on a lower face, i.e., an inner face, of the wall 29BA of the cover 29B, fixed is the head holder 5, which will be described further below. The head holder 5 is located at a widthwise center in the cover 29B and protrudes vertically downward.

<Head Holder 5 and Thermal Head 50>

As shown in FIG. 28, the head holder 5 includes a base 51, two (2) protrusive portions 51B, conveyer rollers 51C, 51D, and two (2) fitting portions 51E. The base 51 is formed to have a shape of a rectangular plate. The base 51 is fixed to the lower face of the wall 29BA of the cover 29B at an upper end thereof at an upper and facing position with respect to the platen roller P and extends vertically downward. The base 51 spreads in a direction orthogonal to the front-rear direction. In the following paragraphs, unless otherwise noted, directions related to the head holder 5 will be based on the posture of the cover 29B being at the first position (closed position) while the second case 29A is at the third position (closed position), as shown in FIG. 26 and as indicated by the arrows in FIG. 26.

The base 51 holds the thermal head 50 at a lower end portion thereof. The thermal head 50 extends longitudinally in the widthwise direction between the fitting portions 51E, which will be described further below. The thermal head 50 may be a liner thermal head, which has a plurality of heating elements aligned in line in the widthwise direction. The base 51 has the fitting portions 51E at the widthwise ends thereof. The fitting portions 51E are plate members each having a recessed area. The protrusive portions 51B are each arranged at an upper position with respect to the fitting portion 51E and protrudes outward in the widthwise direction.

The base 51 holds the conveyer roller 51D on one side of the thermal head 50 in the front-rear direction and the conveyer roller 51C on the other side of the thermal head 50 in the front-rear direction. In particular, the base 51 holds the conveyer roller 51D and the conveyer roller 51C at a rearward position and a frontward position with respect to the thermal head 50, respectively. The conveyer roller 51C and the conveyer roller 51D are located at lower end areas in the base 51 with the thermal head 50 intervening therebetween in the front-rear direction. The conveyer rollers 51C, 51D each has a cylindrical shape extending in the widthwise direction. The conveyer rollers 51C, 51D are rotatably supported by the base 51.

<Ink Ribbon Supporting Member 3>

As shown in FIG. 28, to the ink ribbon supporting member 3, the cartridge case 4 may be attached from the upper side. The cartridge case 4 holds ribbon rolls R1, R2 (see FIG. 5). In other words, to the ink ribbon supporting member 3, the ink ribbon R held by the cartridge case 4 is attachable.

The ink ribbon supporting member 3 is stored in the second case 29A and fixed to the second case 29A (see FIG. 27). FIG. 27 shows the ink ribbon supporting member 3 stored in the second case 29A, which is located at the fourth position (open position). FIG. 28 shows the ink ribbon supporting member 3 stored in the second case 29A, which is located at the third position (closed position). In the following paragraphs, unless otherwise noted, directions related to the ink ribbon supporting member 3 will be based on the posture of the ink ribbon supporting member 3 stored in the second case 29A being at the third position (closed position), as shown in FIG. 28 and as indicated by the arrows in FIG. 28. When the second case 29A is at the third position (closed position), a part of the ink ribbon supporting member 3 which is in a rearward area is located to be higher than the medium storage 212 (see FIG. 27) in the first case 21. Meanwhile, another part of the ink ribbon supporting member 3 which is in a frontward area is located to be lower than the cover 29B (see FIG. 26) being at the first position (closed position).

As shown in FIG. 27, the ink ribbon supporting member 3 includes two (2) sidewalls 31, each of which has a shape of a plate. The side walls 31 on the right and on the left are fixed to inner surfaces of a rightward wall, i.e., the wall 29AB, and a leftward wall, i.e., the wall 29AC, respectively. The sidewalls 31 spread orthogonally to the widthwise direction. On an upper edge of each sidewall 31, at frontward positions with respect to a center of the sidewall 31 in the front-rear direction, arranged are two (2) protrusive portions 31B. Each protrusive portion 31B has a cylindrical shape protruding upward from the upper edge of the sidewall 31. The protrusive portions 31B on each sidewall 31 are spaced apart from each other in the front-rear direction.

Benefits by the Embodiments

According to the first, third, and fourth embodiments, the thermal-transfer printers 1A, 1C, 1D have the openings 211, 211, 211 at the upper end position thereof, the first cases 21, 26, 21 to store the medium rolls Q, Q, Q therein, and the second cases 22, 27, 29A, which are attached to the first case 21, 26, 21 to be openable/closeable, respectively. The second cases 22, 27, 29A have the openings 221, 222; the openings 271, 272; and the openings 291, 292; respectively, and are located to be higher than the first case 21, 26, 21, respectively. The thermal-transfer printers 1A, 1C, 1D include the ink ribbon supporting members 3, 3, 3, which are attached to the first cases 21, 26, 21, to move along with the first cases 21, 26, 21, respectively, and by which the ink ribbons R, R, R are supported. The thermal-transfer printers 1A, 1C, 1D include the covers 23, 28, 29A, which are attached to the second cases 22, 27, 29A, to be openable or closeable to the openings 222, 272, 291, respectively. The thermal-transfer printers 1A, 1C, 1D include the head holders 5, 5, 5, which are attached to the lower faces of the covers 23, 28, 29A, respectively, to hold the thermal heads 50, 50, 50. In order to exchange the medium roll Q with another medium roll Q, the second cases 22, 27, 29A may be opened; on the other hand, in order to exchange the ink ribbon R with another ink ribbon R, the covers 23, 28, 29B may be opened. Thus, parts to be moved or operated may differ depending on the consumable items, such as the medium rolls Q and the ink ribbons R, which are to be exchanged. Therefore, the user may access and find the consumable items to be exchanged more easily and clearly.

According to the first, third, and fourth embodiments, the outer surfaces of the first cases 21, 26, 21 and the second cases 22, 27, 29A form the exterior faces of the thermal-transfer printers 1A, 1C, 1D, respectively. Therefore, a quantity of the parts in the thermal-transfer printers 1A, 1C, 1D may be restrained from being increased.

According to the first, third, and fourth embodiments, between the outer surfaces of the first cases 21, 26, 21 and the second cases 22, 27, 29A, respectively, no substantial difference in depth or width is caused. Therefore, exterior appearances of the thermal-transfer printers 1A, 1C, 1D without different-leveled tiers may be prevented from being disrupted.

According to the third embodiment, the sideward walls, i.e., the walls 27B, 27C, of the second case 27 are curved inward at the upper portions, and the sideward ends of the cover 28 are located inward with respect to the sideward walls of the second case 27. Therefore, rigidity of the sideward walls, i.e., the walls 27B, 27C, of the second case 27 may be improved.

According to the first, third, and fourth embodiments, upper ends of the frontward faces, i.e., the walls 22A, 27A, 29AA, of the second cases 22, 27, 29A are located to be lower than the upper ends of the sideward walls, i.e., the walls 22B, 22C, the walls 27B, 27C, the walls 29AB, 29AC, respectively. Therefore, with the lowered upper ends, the ink ribbons R, R, R may be placed in and removed from the ink ribbon supporting members 3, 3, 3 through the openings 222, 272, 291 easily.

According to the third embodiment, the sideward ends of the cover 28 are curved downward. Therefore, rigidity of the cover 28 may be improved.

According to the first and third embodiments, the thermal-transfer printers 1A, 1C have the covers 23, 28 and the locking devices 223, 281, which may lock the covers 23, 28 to the second cases 22, 27, respectively. Therefore, the covers 28, 29B may be restrained from opening when the second covers 22, 27 are opened.

According to the first and third embodiments, the head holders 5, 5 are pivotably supported by the linkages 233, 233, which link the head holders 5, 5 with the covers 23, 28, respectively. In other words, the head holder 5 is pivotable about the linkage 233 serving as a fulcrum. The head holder 5 pivoted may move downward with the thermal head 50 being hooked with the ink ribbon R between the ribbon rolls R1, R2 stored in the cartridge case 4, even when an amount of a gap between the ribbon roll R1 and the ribbon roll R2 is small. Thus, the cartridge case 4 may be downsized, and the thermal-transfer printers 1A, 1C may be downsized accordingly.

According to the first and third embodiments, the first axes X11, X31 being the pivot axes for the covers 23, 28 are located frontward positions with respect to the third axes X13, X33 being the pivot axes for the second cases 22, 27, respectively. Therefore, with the covers 23, 28 being opened, routes continuous to the first cases 21, 26 may be narrowed. In this regard, the user may not access the medium rolls Q, Q easily through the openings 222, 272, respectively. Therefore, the medium rolls Q, Q may be prevented from being touched undesirably by the user. In this regard, the user may be guided to open the second cases 22, 27 in order to reach the medium rolls Q, Q.

According to the first and third embodiments, each ink ribbon supporting member 3 has the guides 31D, each of which is formed to curve in an arc, to guide the head holder 5 to move there-along, in the sidewalls 31. With the guides 31D in the sidewalls 31, the head holder 5 may move vertically without colliding with the ribbon rolls R1, R2. Therefore, the amount of the gap between the ribbon rolls R1, R2 may be reduced, and the thermal-transfer printers 1A, 1C may be downsized.

According to the fourth embodiment, in the thermal-transfer printer 1D, the third axis X43 being the pivot axis for the second case 29A and the first axis X41 being the pivot axis for the cover 29B extend in the different directions; therefore, the cover 29B and the second case 29A may move in the different directions to be opened. In this regard, the second case 29A may be prevented from being opened unintentionally when the user intends to open the cover 29B.

According to the first embodiment, the cover 23 has at least one of the operation interface 234 and the display 235 on the upper face thereof. Therefore, the user may operate the operation interface 234 or recognize the contents in the display 235 easily.

More Examples

Although examples of carrying out the invention have been described, those skilled in the art will appreciate that there are numerous variations and permutations of the thermal-transfer printer that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

The following paragraphs describe more examples derivable from any of the first, second, third, and fourth embodiments. In the following paragraphs, the examples are described representatively based on the first embodiment.

For example, the ink ribbon supporting member 3 may be supported directly by the second case 22 or indirectly through a linkage attached to the second case 22.

For another example, based on the cover 23 being at the first position (closed position), the cover 23 may be bended or curved downward at the frontward and sideward portions so that lower ends of the bended or curved portions may align at a same height within the thermal-transfer printer 1A. With the lower ends of the cover 23 aligning at the same height, the exterior appearance of the thermal-transfer printer 1A may be improved. Moreover, a mold to cast the cover 23 may be simplified, and manufacturing cost for the thermal-transfer printer 1A may be reduced.

For another example, based on the cover 23 being at the first position (closed position), the cover 23 may be arranged such that the lower face of the cover 23 contacts the cartridge case 4 attached to the ink ribbon supporting member 3. Thereby, even when the ink ribbon supporting member 3 is not fixed in the first case 21, the ink ribbon supporting member 3 may be stabilized in the first case 21 by the cover 23 through the cartridge case 4.

For another example, the first axis X11 being the pivot axis for the cover 23 may be located in a midst area among virtually trisected areas in the front-rear direction within the second case 22 between the wall 22A and wall 22D. Thereby, routes continuous to the medium storage 212, in which the medium roll Q being the rolled printing medium may be stored, may be narrowed. In this regard, the user may not access the medium rolls Q easily through the opening 222 and may be guided to open the second case 22. Therefore, the medium rolls Q may be prevented from being touched undesirably by the user.

For another example, the subsidiary arm 6 may be pivotably supported directly by the second case 22 or indirectly through a linkage member.

For another example, the ink ribbon supporting member 3 may be pivotably supported directly by the second case 22 or indirectly through a linkage member. For another example, the ink ribbon supporting member 3 may be fixed to the first case 21 or to the second case 22. For another example, the head arm 9 in the second embodiment may be pivotably attached to one of the first case 21 and the second case 24.

For another example, the ribbon rolls R1, R2, being the rolls of ink ribbon R may not necessarily be stored in the cartridge case 4 to be attached to the ink ribbon supporting member 3 but may be attached directly to the ink ribbon supporting member 3.

For another example, the medium roll Q may not necessarily be stored entirely within the first case 21, but at least a part of the medium roll Q may project upward from the upper end of the first case 21.

What is claimed is:

1. A thermal-transfer printer, comprising:

a first case comprising a first opening on an upper side thereof, the first case being configured to store at least a part of a printing medium;

a second case located on the upper side of the first case, the second case being attached movably to the first case to open and close the first opening, the second case comprising a second opening on an upper side thereof under a condition where the second case closes the first opening and a third opening on a lower side thereof under the condition where the second case closes the first opening;

an ink ribbon supporting member, to which an ink ribbon is attachable, the ink ribbon supporting member being attached to one of the first case and the second case;

a cover attached movably to the second case, the cover being configured to open and close the second opening, the cover comprising an inner face facing toward the second case and an outer face facing opposite to the second case under a condition where the cover closes the second opening; and a head holder attached to the inner face of the cover, the head holder being configured to hold a printing head, wherein the head holder is movable in conjunction with the cover moving to open and close the second opening, and wherein the ink ribbon supporting member remains inside of the one of the first case and the second case with opening and closing movement of the cover.

2. The thermal-transfer printer according to claim 1, wherein, under the condition where the second case closes the first opening, an outer face of the first case and an outer face of the second case form a part of an exterior face of the thermal-transfer printer.

3. The thermal-transfer printer according to claim 2, wherein the outer face of the first case and the outer face of the second case align on a plane without forming different-leveled tiers.

4. The thermal-transfer printer according to claim 1, wherein the second case comprises sideward walls, wherein upper end portions of the sideward walls under the condition where the second case closes the first opening are curved inward, and wherein sideward ends of the cover are, under the condition where the cover closes the second opening, located inward with respect to the sideward walls of the second case.

5. The thermal-transfer printer according to claim 1, wherein a frontward end portion of the cover under the condition where the cover closes the second opening is curved downward.

6. The thermal-transfer printer according to claim 1, wherein the second case comprises a frontward wall and sideward walls; and wherein, under the condition where the second case closes the first opening, an upper end of the frontward wall is located to be lower than upper ends of the sideward walls.

7. The thermal-transfer printer according to claim 1, wherein sideward end portions of the cover under the condition where the cover closes the second opening are curved downward.

8. The thermal-transfer printer according to claim 1, wherein, under the condition where the cover closes the second opening, a frontward end portion and sideward end portions of the cover are curved downward, and lower ends of the frontward end portion and the sideward end portions of the cover are located at a same height within the thermal-transfer printer.

9. The thermal-transfer printer according to claim 1, further comprising a locking device configured to lock the cover to the second case.

10. The thermal-transfer printer according to claim 1, wherein, under the condition where the cover closes the second opening, the inner face of the cover contacts a cartridge case to which the ink ribbon is attachable, the cartridge case being attached to the ink ribbon supporting member.

11. The thermal-transfer printer according to claim 1, wherein the head holder is linked with the cover through a linkage and is pivotable about the linkage serving as a fulcrum.

12. The thermal-transfer printer according to claim 1, wherein the cover is pivotable about a cover axis to open and close the second opening, and the second case is pivotable about a case axis to open and close the first opening; and wherein the cover axis is located at a frontward position with respect to the case axis within the second case.

13. The thermal-transfer printer according to claim 1, wherein the cover is pivotable about a cover axis to open and close the second opening, and the second case is pivotable about a case axis to open and close the first opening, wherein the second case comprises a frontward wall and a rearward wall, the frontward wall and the rearward wall being located to be apart from each other in a front-rear direction, and wherein the cover axis is located in a midst area among virtually trisected areas in the front-rear direction between the frontward wall and the rearward wall in the second case.

14. The thermal-transfer printer according to claim 1, wherein the ink ribbon supporting member comprises sideward walls at sideward ends thereof and a guide in each of the sideward walls, the guide being curved in an arc and configured to guide the head holder to move there-along.

15. The thermal-transfer printer according to claim 1, wherein the cover is pivotable about a cover axis to open and close the second opening, and the second case is pivotable about a case axis to open and close the first opening; and wherein the cover axis and the case axis extend in different directions.

16. The thermal-transfer printer according to claim 1, wherein the cover comprises at least one of an operation interface and a display on the outer face.

17. The thermal-transfer printer according to claim 16, wherein the cover comprises the operation interface and the display on the outer face.

18. The thermal-transfer printer according to claim 1, wherein the ink ribbon supporting member is removably attached to the one of the first case and the second case.

19. The thermal-transfer printer according to claim 1, wherein the ink ribbon supporting member is fixed immovably to the second case.

20. The thermal-transfer printer according to claim 1, wherein the first opening and the third opening are at least partly continuous with each other under the condition where the second case closes the first opening.

* * * * *